US010730679B2

(12) United States Patent
Zhang

(10) Patent No.: US 10,730,679 B2
(45) Date of Patent: Aug. 4, 2020

(54) STANDING-TYPE AIR-FILLED PACKAGING APPARATUS AND MANUFACTURING METHOD THEREFOR

(71) Applicant: Shanghai Air-Paq Composite Material Co., Ltd., Shanghai (CN)

(72) Inventor: Jiaying Zhang, Shanghai (CN)

(73) Assignee: Shanghai Air-Paq Composite Material Co., Ltd., Shanghai (CN)

( * ) Notice: Subject to any disclaimer, the term of this patent is extended or adjusted under 35 U.S.C. 154(b) by 441 days.

(21) Appl. No.: 15/528,091

(22) PCT Filed: Nov. 18, 2015

(86) PCT No.: PCT/CN2015/094893
§ 371 (c)(1),
(2) Date: Sep. 13, 2017

(87) PCT Pub. No.: WO2016/078580
PCT Pub. Date: May 26, 2016

(65) Prior Publication Data

US 2018/0093809 A1 Apr. 5, 2018

(30) Foreign Application Priority Data

Nov. 19, 2014 (CN) ..... 2014 1 0663185
Nov. 21, 2014 (CN) ..... 2014 1 0673714
Apr. 29, 2015 (CN) ..... 2015 1 0215813
Nov. 18, 2015 (WO) ..... PCT/CN2015/094893

(51) Int. Cl.
*B65D 81/02* (2006.01)
*B65D 81/03* (2006.01)
(Continued)

(52) U.S. Cl.
CPC ..... *B65D 81/03* (2013.01); *B31D 5/0073* (2013.01); *B65D 23/08* (2013.01); *B65D 25/04* (2013.01);
(Continued)

(58) Field of Classification Search
CPC ..... B65D 81/03; B65D 81/052; B65D 23/08; B65D 25/04; B65D 83/0055; B65D 2207/00; B65D 2581/055
(Continued)

(56) References Cited

U.S. PATENT DOCUMENTS 7,066,331 B2 * 6/2006 Koyanagi ..... B65D 81/052 206/522
9,174,788 B2 * 11/2015 Liao ..... B65D 81/05
(Continued)

*Primary Examiner* — Luan K Bui
(74) *Attorney, Agent, or Firm* — Raymond Y. Chan; David and Raymond Patent Firm

(57) ABSTRACT

A standing-type air-filled packaging apparatus and a manufacturing method therefor are provided. The apparatus includes an inflatable body and an inflation valve. The inflatable body includes multiple inflatable units that are formed by stacking together at least two layers of air chamber films and are connected with each other. The inflatable units are heat-sealed and bent to form an air-filled packaging apparatus provided with at least one accommodating chamber used for accommodating an item to be packaged. The inflation valve is mounted on the inflatable body to inflate the inflatable body. At least one distal side of the solid air-filled packaging apparatus forms an annular support part. When the air-filled packaging apparatus is inflated, the annular support part is suitable for standing on a surrounding surface, thus allowing the packaging apparatus to be in a firm standing state.

4 Claims, 12 Drawing Sheets

(51) Int. Cl.

| | |
|---|---|
| ***B65D 23/08*** | (2006.01) |
| ***B31D 5/00*** | (2017.01) |
| ***B65D 25/04*** | (2006.01) |
| ***B65D 81/05*** | (2006.01) |
| ***B65D 83/00*** | (2006.01) |
| ***G07F 11/00*** | (2006.01) |
| *B65B 55/20* | (2006.01) |

(52) U.S. Cl.
CPC ..... *B65D 81/052* (2013.01); *B65D 83/0055* (2013.01); *G07F 11/00* (2013.01); *B65B 55/20* (2013.01); *B65D 2207/00* (2013.01); *B65D 2581/055* (2013.01)

(58) Field of Classification Search
USPC ..... 206/522, 591, 592, 594; 383/3
See application file for complete search history.

(56) References Cited

U.S. PATENT DOCUMENTS

| | | | | |
|---|---|---|---|---|
| 9,731,885 | B2 * | 8/2017 | Liao | B65D 81/052 |
| 10,138,044 | B2 * | 11/2018 | Liao | B65D 81/03 |
| 2007/0017844 | A1 * | 1/2007 | Komatsu | B65D 81/052 206/521 |
| 2007/0051655 | A1 * | 3/2007 | Yoshifusa | B65D 81/052 206/522 |
| 2007/0131575 | A1 * | 6/2007 | Abe | B65D 81/052 206/522 |
| 2007/0246394 | A1 * | 10/2007 | Yoshifusa | B65D 81/052 206/522 |
| 2013/0168286 | A1 * | 7/2013 | Liao | B65D 81/052 206/522 |
| 2019/0144190 | A1 * | 5/2019 | Zhang | B65D 81/03 383/3 |

* cited by examiner

B-B

STANDING-TYPE AIR-FILLED PACKAGING APPARATUS AND MANUFACTURING METHOD THEREFOR

CROSS REFERENCE OF RELATED APPLICATION

This is a U.S. National Stage under 35 U.S.C. 371 of the International Application Number PCT/CN2015/094893, filed Nov. 18, 2015, which claims priority under 35 U.S.C. 119(a-d) to Chinese application number 201410663185.4, filed Nov. 19, 2014, Chinese application number 201410673714.9, filed Nov. 21, 2014, and Chinese application number 201510215813.7, filed Apr. 29, 2015. The afore-mentioned patent applications are hereby incorporated by reference in their entireties.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an air packaging device and a producing method therefor, and more particularly to a standing-type air-filled packaging apparatus and manufacturing method therefor.

Description of Related Arts

During the modern logistics and commodity storage, the use of air bags becomes more and more widely. The air bags can be used for packaging chemicals, electronic products, food, precision instruments, ceramic products, glass products and other packaging products and have provided functions of damp proof, shock absorption, resist compression and other functions, which well protecting the product safety and becoming the most popular product packaging method.

As the traditional air bags are non-standing type, after the user using the traditional air packaging bags to package products, the air bags cannot be placed upright and can only be placed flat wise. As a result, when the goods are shipped to customers in commercial, the appearance of the product images are not well, if the products to be packaged are high-end products, such as high-grade red wine, etc., the air bags cannot show the grade of the red wine, which is equivalent of decreasing the grades of the high-end products from the appearance of the air bags.

For the traditional packaging bags for packaging red wines, the bottleneck of the bottle is used in the same size with the bottle body of the bottle. There is no specifically package design for the bottleneck, when the packaging is completed, the bottleneck of the red wine bottle has a larger gap with the package bag, and thereby making the package bag cannot be tightly fit with the bottle. During the transport process, bottles in the package bag will be shaking and is not packaged enough, etc., so that affecting the air cushioning effect.

Further, after the traditional packaging bag is packaged with a bottle, in order to prevent the bottle from slipping out, the opening of the air packaging bag is usually closed so that the bottle is fixed in a closed air packaging bag. The consumer obtains the products packaged by the air packaging bag, it is often difficult to open, and sometimes the air packaging bag is needed to be destroyed to take out the product inside, making the air packaging bag cannot be reused. If the consumer opens the air packaging bag in a wrong way or applies' too much force, it is easy to damage the products inside the air packaging bag, causing serious losses.

In addition, the traditional air packaging bag only forms a storage cavity, during the packaging of bottles; basically the air packaging bag is a single package. In other words, a packaging bag is only used to package only one bottle. When a multiple bottles are needed to be packaged, a plurality of the air packaging bags are needed, resulting in increasing packaging costs, increasing the volume, occupying much more space, and being not easy to transport and storage.

When the traditional air packaging bag is used for packaging square shaped items, there is only one accommodating cavity, the complete sets of packaged items such as complete sets of glass cannot be packaged, if complete sets of packaged items are packaged together, the items are easy to impact with each other, causing damage instead of being upright. When the various glasses are placed in the air packaging bag, the glasses are prone to be skew and impact with each other, causing serious consequences.

Therefore, there is an urgent need to design a standing air packaging device to better meet the needs of modern people.

SUMMARY OF THE PRESENT INVENTION

The invention is advantageous in that it provides a standing-type air-filled packaging apparatus and manufacturing method therefor, the standing-type air-filled packaging apparatus is capable of standing up in a standing manner on the basis of a standing manner of packaged items after packaging the packaged items, thereby increasing safety and aesthetics.

Another advantage of the invention is to provide a standing-type air-filled packaging apparatus and manufacturing method therefor, Another advantage of the invention is to provide a standing-type air-filled packaging apparatus and manufacturing method therefor, which simultaneously packages a plurality of items by forming a plurality of accommodating cavities, and each of the two items has a cushioning interlayer to prevent damage to the items, thereby ensuring the safety of the items.

Another advantage of the invention is to provide a standing-type air-filled packaging apparatus and manufacturing method therefor, which not only packages a cylindrical item, but also packages a square item, so that the item stands vertically in the standing-type air-filled packaging apparatus for storage and transport.

Another advantage of the invention is to provide a standing-type air-filled packaging apparatus and manufacturing method therefor, which is provided with a special bottleneck packaging portion, so that when the standing-type air-filled packaging apparatus is used to package bottles, the bottles are firmly packaged.

Another advantage of the invention is to provide a standing-type air-filled packaging apparatus and manufacturing method therefor, wherein an opening of the standing-type air-filled packaging apparatus is easily sealed and opened, and the user can freely open the opening thereof and take out the product inside thereof without damaging the standing-type air-filled packaging apparatus, thereby the standing-type air-filled packaging apparatus being reused.

Another advantage of the invention is to provide a standing-type air-filled packaging apparatus and manufacturing method therefor, the standing-type air-filled packaging apparatus is convenient and fast in packaging and can effectively shorten the packaging flow and save manpower.

Another advantage of the invention is to provide a standing-type air-filled packaging apparatus and manufacturing method therefor, the standing-type air-filled packaging apparatus is made of a transparent material and the user can directly see whether or not the items thereof are damaged and are easily inspected.

Another advantage of the invention is to provide a standing-type air-filled packaging apparatus and manufacturing method therefor, the standing-type air-filled packaging apparatus is capable of being closely contacted with the items to be packaged to prevent a gap between the standing-type air-filled packaging apparatus and the items, thereby achieving a better air cushioning effect.

Another advantage of the invention is to provide a standing-type air-filled packaging apparatus and manufacturing method therefor, the standing-type air-filled packaging apparatus is provided with a non-return valve, the inflating is completed at a time and automatically locking and each of the air chambers is separately provided, wherein if a part of the air chambers are damaged, others will not be damaged, thereby not affecting the air cushioning effect.

Another advantage of the invention is to provide a standing-type air-filled packaging apparatus and manufacturing method therefor, which is made of functional materials so as to have various functions such as heat preservation and radiation protection to meet transportation and storage requirements.

Another advantage of the invention is to provide a standing-type air-filled packaging apparatus and manufacturing method therefor, which is simple in manufacturing, low in cost and widely used.

Additional advantages and features of the invention will become apparent from the description which follows, and may be realized by means of the instrumentalities and combinations particular point out in the appended claims.

According to the present invention, the foregoing and other objects and advantages are attained by a standing-type air-filled packaging apparatus, comprising:

at least one inflatable main bodies, wherein the inflatable main body comprises a plurality of connected inflatable cells formed by at least two chamber layers which are overlapped with each other, wherein the inflatable cells are heat sealed and bent to form an air-filled packaging apparatus having at least one accommodating cavity for accommodating items to be packaged; and at least one inflating valve mounted to the inflatable main body so as to inflate the inflatable main body, wherein at least one end side of the air-filled packaging apparatus forms an annular supporting portion, after the air-filled packaging apparatus is inflated, the annular supporting portion is suitable for standing on a surrounding surface, thereby the air-filled packaging apparatus being in a firm standing state.

Preferably, a portion of the inflatable main body is heat sealed to form the annular supporting portion, wherein the annular supporting portion comprises an inner supporting portion and an outer supporting portion which are integrally formed and overlapped with each other, an annular supporting surface is formed on the connecting portion of the inner supporting portion and the outer supporting portion, the annular supporting surface is suitable to contact with the surrounding surface, thereby the air-filled packaging apparatus being in a firm standing state.

Preferably, the portion of the inflatable cells is provided with interconnecting seams to connect the inner supporting portion with the outer supporting portion on a side which is apart from the annular supporting surface.

Preferably, the portion of the inflatable cells further forms an end wall which is extended from one end which the inner supporting portion apart from the annular supporting surface to the inner supporting portion, wherein the annular supporting surface and the end wall are in the different planes.

Preferably, a top side of the air-filled packaging apparatus forms the annular supporting portion and the end wall is a top wall.

Preferably, a bottom side of the air-filled packaging apparatus forms the annular supporting portion and the end wall is a bottom wall.

Preferably, a top side of the air-filled packaging apparatus and a bottom side thereof respectively form the annular supporting portion.

Preferably, the annular supporting portion is provided with one or more lists of bending seams such that the annular supporting portion is easy to be bent.

Preferably, one or more inflatable cells on two sides of the portion of the inflatable main body is provided with one or more rejecting seams so as to reduce the inflating amount to form an folding unit which is easy to be folded.

According to the present invention, the foregoing and other objects and advantages are attained by a standing-type air-filled packaging apparatus, comprising:

at least one inflatable main body, wherein the inflatable main body comprises a plurality of connected inflatable cells formed by at least two chamber layers which are overlapped with each other, wherein the inflatable cells are heat sealed and bent to form an air-filled packaging apparatus having at least one accommodating cavity for accommodating items to be packaged; and at least one inflating valve mounted to the inflatable main body so as to inflate the inflatable main body, wherein at least one end side of the air-filled packaging apparatus forms a recessed cushioning chamber after the air-filled packaging apparatus is inflated, so that the end side is suitable for making the air-filled packaging apparatus being in a firm standing state.

Preferably, the end side of the standing-type air-filled packaging apparatus after being inflated comprises an end wall and two or more supporting sections which are protruded from the end wall, so that the end wall and the supporting section form the cushioning chamber.

Preferably, the end side of the standing-type air-filled packaging apparatus comprises a first list interconnecting seam, a second list interconnecting seam, a third list interconnecting seam and a fourth list interconnecting seam which heat seal two layers of the chamber layer of the inflatable cells, wherein the first list interconnecting seam, the second list interconnecting seam, the third list interconnecting seam and the fourth list interconnecting seam are provided to make the inflatable cells communicate in the lengthwise direction, wherein the first and second list interconnecting seam further are heat sealed together so as to form the supporting section which is folded back between the first and second interconnecting seam, wherein the third and fourth interconnecting seam further are heat sealed to form other supporting section which is folded back between the third and fourth interconnecting seam, wherein the end wall is formed between the second and third interconnecting seam.

Preferably, the end wall is selected from the group consisting of top wall and bottom wall.

Preferably, two of the supporting sections are heat sealed by a side sealing line so as to form an entire annular supporting portion.

Preferably, further provided with one or more lists of bending seams between the first and second list interconnecting seam and between the third and fourth list interconnecting seam, so that the supporting section is suitable to be bent along the bending seams.

Preferably, each interconnecting seam of each list interconnecting seams is provided on the middle or on two sides of the inflatable cells.

Preferably, each interconnecting seam of each list interconnecting seams is provided on the middle or on two sides of the inflatable cells.

Preferably, the inflatable cells further comprises a plurality of sub accommodating cavities of the accommodating cavity by heat sealing so as to accommodate a plurality of items to be packaged.

Preferably, the accommodating cavity has an extended column shape.

Preferably, the accommodating cavity is generally square.

Preferably, the inflating valve is a non-return valve comprising two overlapped sealing films provided inside the two chamber layers, wherein air enters into each of the inflatable cells between the two chamber layers and the two chamber layers are bonded together automatically so as to prevent air reverse osmosis.

Preferably, the inflating valve is a non-return valve comprising two overlapped sealing films provided inside the two chamber layers and a non-return sealing film provided between the two sealing films.

According to the present invention, the foregoing and other objects and advantages are attained by a manufacturing method for a standing-type air-filled packaging apparatus, comprising the steps of:

(a) overlapping and heat sealing two chamber layers and at least two sealing films forming at least one inflating valve so as to form an inflatable main body, wherein the inflatable main body forms a plurality of connected inflatable cells by the heat sealing of a plurality of lists of dividing seams, wherein the inflating valve is provided to achieve a non-return inflating performance of the inflatable main body;

(b) the inflatable main body forming an air-filled packaging apparatus after a series heat sealing and bending, wherein the air-filled packaging apparatus forms at least one accommodating cavity after being inflated so as to package at least one item to be packaged; and (c) forming an annular supporting portion on a bottom side of the air-filled packaging apparatus, so that the air-filled packaging apparatus is suitable to stand on an surrounding surface.

Preferably, the inflatable cells are folded back twice and an interconnecting seam heat seals four chamber layers so as to from the annular supporting portion on the bottom side, wherein a bottom wall is formed between the annular supporting portion.

Preferably, in the step (c), four lists of the interconnecting seams are spaced on the inflatable cells to heat seal the two chamber layers such that the inflatable cells are communicably inflated along a lengthwise direction, wherein two adjacent lists of the interconnecting seams are connected with each other to form at least two supporting sections, and two middle lists of the interconnecting seams are not connected with each other to form the bottom wall in the middle, wherein the supporting sections surround the bottom wall and two sides are connected to form the annular supporting portion.

Preferably, in the step (c), the bottom wall and a bottom portion of the annular supporting portion are in two different planes.

Preferably, in the step (c), a cushioning chamber is formed between the annular supporting portion and the bottom wall after the inflatable cells being inflated.

Preferably, further comprising a step: the inflatable cells are folded back twice and an interconnecting seam heat seals four chamber layers so as to from another annular supporting portion on the top side, wherein a top wall is formed between the annular supporting portion.

Preferably, four lists of the interconnecting seams are spaced on the inflatable cells to heat seal the two chamber layers such that the inflatable cells are communicably inflated along a lengthwise direction, wherein two adjacent lists of the interconnecting seams are connected with each other to form another two supporting sections, and two middle lists of the interconnecting seams are not connected with each other to form a top wall in the middle, wherein other two supporting sections surround the top wall and two sides are connected to form the annular supporting portion.

Preferably, a rejecting seam heat seals the two chamber lawyers on the connection of two adjacent interconnecting seams so as to reduce the inflating amount to easy to be folded.

Preferably, one or more lists of bending seams which heat seal the two chamber layers are provided between two adjacent lists of the interconnecting seams.

Preferably, further comprises a step: fix the uninflated inflatable main body to an inner wall of a packaging box which is in a folded state, when the inflatable main body is inflated, the inflatable main body automatically stretches the packaging box.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
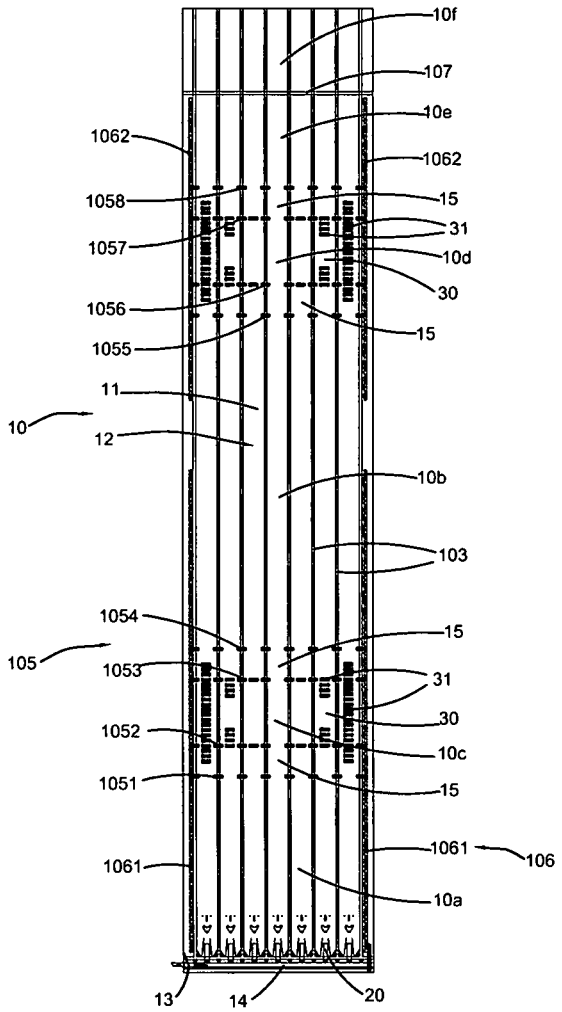
FIG. 1 is a perspective view of a standing-type air-filled packaging apparatus according to a first preferred embodiment of the present invention, wherein the standing-type air-filled packaging apparatus is not inflated and is unfolded.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

The present invention provides a standing-type air-filled packaging apparatus which is capable of being placed in a standing state and keeping the items in a normal place. The standing-type air-filled packaging apparatus packs not only a cylindrical item but also other items such as a square shape therewith. After packing, the standing-type air-filled packaging apparatus has a better appearance and the items inside has a better protection to be packaged.

Referring to FIG. 1 to FIG. 4 of the drawings, a first preferred embodiment of a standing-type air-filled packaging apparatus of the present invention is illustrated. As shown in FIG. 1 to FIG. 4 of the drawings, the standing-type air-filled packaging apparatus comprises an inflatable main body 10 and at least one inflating valve 20, wherein the inflating valve 20 is mounted to the inflatable main body 10 and the inflatable main body 10 is inflated by the inflating valve 20, so that the inflatable main body 10 has an air cushioning effect to protect the item to be packaged.

The inflatable main body 10 comprises a first chamber layer 101 and a second chamber layer 102 which are overlapped with each other to form at least one inflatable cells 11, wherein each of the inflatable cells 11 has an inflatable cavity 12 and the inflating valve 20 is provided at the port of each of the inflatable cells 11 so as to inflate the inflatable cells 11 to have an air cushioning effect. The first chamber layer 101 and the second chamber layer 102 further form an air inflating opening 13 and an inflating channel 14, wherein the inflating channel 14 is communicated with the inflatable cavity 12 and the air inflating opening 13 is adapted to install an external air pump so as to distribute the air into each of the inflatable cells 11 via the inflating channel 14, so that the inflatable main body 10 has an air cushioning effect to protect the item to be packaged. The inflatable main body 10 further comprises a plurality of dividing seams 103 such that the inflatable main body 10 forms a plurality of the inflatable cells 11 and each of the inflatable cells 11 is able to be inflated separately.

In the preferred embodiment, the inflatable main body 10 is folded to form the standing-type air-filled packaging apparatus with an accommodating cavity 100 adapted to be packed with cylindrical articles such as bottles and lamps. For example, the size of the accommodating cavity 100 is adapted to the size of a single wire bottle that the wire bottle is able to stand within the accommodating cavity 100, and each of the side walls of the inflatable main body 10 is able to be tightly attached to the wire bottle, so that the wire bottle is firmly placed within the accommodating cavity 100 to have a better protection.

In this preferred embodiment of the present invention, the standing-type air-filled packaging apparatus comprises a front side wall 10*a*, a rear side wall 10*b*, a bottom wall 10*c*, a top wall 10*d*, a top wall cover 10*e* and a plug closing wall 10*f*, wherein two sides of the front side wall 10*a* are connected with two sides of the rear side wall 10*b*, the periphery of the bottom wall 10*c* is connected with the bottom end of the front side wall 10*a* and the bottom end of the rear side wall 10*b*, one side of the top wall 10*d* is connected to the top end of the rear side wall 10*b*, other side of the top wall 10*d* is connected to the top wall cover 10*e*, the top wall cover 10*e* is connected with the plug closing wall 10*f*, so that the item to be packed is placed into the accommodating cavity 100 via an opening formed by the connecting portion of the front side wall 10*a* and the top wall cover 10*e*, the connecting portion of the front side wall 10*a* and the top wall cover 10*e* is enclosed via the plug closing wall 10*f*, wherein the plug closing wall 10*f* is detachably enclose the top wall cover 10*e* and the front side wall 10*a* to prevent the item from slipping out and to increase safety, as shown in FIG. 1 to FIG. 4 of the drawings.

Preferably, the length of the front side wall 10*a* is shorter than the length of the rear side wall 10*b*, the sum of the length of the front side wall 10*a* and the length of the rear side wall 10*b* is equal to the length of the rear side wall 10*b*, the plug closing wall 10*f* is able to be inserted into the accommodating cavity 100, so that the connection of the top wall cover 10*e* and the front side wall 10*a* is much more closely, thereby preventing the item to be packaged from slipping out form the accommodating cavity 100.

It is worth mentioning that the inflatable cells 11 are partially formed with one or more folding units 30. For example, two folding units 30 are respectively provided on the bottom wall 10*c* and the top wall 10*d*, so that the bottom wall 10*c* and the top wall 10*d* are folded into similarly a circular or oval shape and the two folding units 30 are respectively and correspondingly provided with two supporting sections 15 on the bottom side and the top side so as to facilitate standing, thereby forming the standing-type air-filled packaging apparatus of the present invention. The standing-type air-filled packaging apparatus not only is able to provide a standing function on the side of the bottom wall 10*c*, but also is able to provide a standing function on the side of the top wall 10*d*.

Further, the inflatable main body 10 comprises a series of blocking seams 31, wherein the blocking seams 31 are provided on a predetermined number of the inflatable cells 11 of the folding units 30 so as to reduce the inflation amount of the folding units 30, so that the inflation amount of the folding units 30 is less than the inflation amount of the other inflatable cells 11 of the inflatable main body 10, thus the folding units 30 is adapted to be folded, thereby the inflatable main body 10 being folded into a desired cubic type.

In the preferred embodiment, the blocking seams 31 are arranged in the inflatable cells 11 arow, wherein two lists of the blocking seams 31 are respectively provided on two inflatable cells 11 of both sides of the inflatable main body 10 in such a manner that the top wall 10*d* and the bottom wall 10*c* are adapted to be folded, so that the top portion and the bottom portion of the standing-type air-filled packaging apparatus are elliptical facilitate standing.

Preferably, the number of the blocking seams 31 of the inflatable cells 11 on the outer side is larger. In other words, the length of the list of the blocking seams 31 which are provided on the second inflatable cells 11 of the two sides of the inflatable main body 10 is longer than the list of the blocking seams 31 which are provided on the first inflatable cells 11 of the inflatable main body 10. In other words, the area of the second inflatable cells 11 of the blocking seams 31 which are provided on the second inflatable cells 11 of the folding units 30 is smaller than the blocking seams 31 which are provided on the first inflatable cells 11 of the folding units 30, so that the top wall 10*d* and the bottom wall 10*c* are easy and convenient to be folded, thereby forming into ellipse shape. In other words, the list arrangement of the rejecting seams 31 make the inflation amount of the top wall 10*d* and the bottom wall 10*c* gradually decreases from the middle to the two ends, thereby forming a stable connection structure and being easy to stand.

According to this preferred embodiment of the present invention, as shown in FIG. 1 of the drawings, partial portion of the inflatable cells 11 forms four folding units 30, each of the folding units 30 are formed by a plurality of rejecting seams 31 arranging on partial portion of two inflatable cells 11, the rejecting seams 31 connected the first chamber layer 101 of the inflatable main body 10 with the second chamber layer 102 of the inflatable main body 10 by heat sealing together without being inflated, the non-heat-sealing position portion around the rejecting seams 31 is still an inflatable structure and each of the inflatable main body 10 is in a communicable state in the longitudinal direction. One skilled in the art will understand that the embodiment of the present invention described above is exemplary only and not intended to be limiting. In actual application, the inflatable cells 11 can also not form the folding units 30 or a different number of the folding units 30 and the shape and the size of the rejecting seams 31 can be designed as desired. In other embodiment of the present invention, the folding units 30 can be implemented as other non-inflatable portion which is uninflated unit as a whole, the inflatable main body 10 which forms the folding units 30 can also communicated with horizontal communication channel of other adjacent inflatable main body 10.

In order to make the edges of the bottom wall 10*c* more securely connected to the rear side wall 10*b* and the front side wall 10*a* and in order to be much more stereoscopic after being folded, a plurality of the interconnecting seams 105 are provided on the inflatable main body 10 and each of the interconnecting seams 105 connected the first chamber layer 101 with the second chamber layer 102 by heat sealing. As shown in FIG. 1 of the drawings, as an example, the interconnecting seams 105 comprises a first list interconnecting seams 1051, a second list interconnecting seams 1052, a third list interconnecting seams 1053, a fourth list interconnecting seams 1054, a fifth list interconnecting seams 1055, a sixth list interconnecting seams 1056, a seventh list interconnecting seams 1057 and a eighth list interconnecting seams 1058, wherein the front side wall 10*a* of the inflatable main body 10 is formed on the downside of the first list interconnecting seams 1051, the bottom wall 10*c* is formed between the second list interconnecting seams 1052 and the third list interconnecting seams 1053, the rear side wall 10*b* of the inflatable main body 10 is formed between the fourth list interconnecting seams 1054 and the fifth list interconnecting seams 1055, the top wall 10*d* is formed between the sixth list interconnecting seams 1056 and the seventh list interconnecting seams 1057, and the eighth list interconnecting seams 1058 is provided at the bottom end of the top wall cover 10*e*.

It is worth to be mentioned that the interconnecting seams 105 can be entirely provided in the inflatable cells 11, partially provided in the inflatable cells 11, or partially provided in the dividing seams 103 which is the heat seal line between two inflatable cells 11. Two adjacent inflatable cells 11 on two sides of the interconnecting seams 105 are communicated with each other, in such a manner that interconnecting seams 105 allows that the inflatable main body 10 is adapted to be bent, thereby the inflatable main body 10 forming the standing-type air-filled packaging apparatus with the accommodating cavity 100.

In the preferred embodiment, the adjacent interconnecting seams 105 are connected to form the supporting section 15, and the connection of two lists of the interconnecting seams 105 can be implemented as heat sealing. In other words, the first list interconnecting seams 1051 is connected with the second list interconnecting seams 1052, the third list interconnecting seams 1053 is connected with the fourth list interconnecting seams 1054, the fifth list interconnecting seams 1055 is connected with the sixth list interconnecting seams 1056, the seventh list interconnecting seams 1057 is connected with the eighth list interconnecting seams 1058, the inflatable cells 11 between two connected interconnecting seams 105 forms the supporting section 15 and four supporting section 15 are formed in total. The four supporting section 15 form an oval-shaped support structure with the bottom wall 10*c* and the top wall 10*d* such that the standing-type air-filled packaging apparatus is able to stand. Take the first list interconnecting seams 1051 and the second list interconnecting seams 1052 as an example, in the practical application, the first list interconnecting seams 1051 and the second list interconnecting seams 1052 first connect the first chamber layer 101 with the second chamber layer 102 together by heat sealing, then the inflatable main body 10 between the first list interconnecting seams 1051 and the second list interconnecting seams 1052 is folded back, and then the first list interconnecting seams 1051 and the second list interconnecting seams 1052 is connected by heat sealing. The first list interconnecting seams 1051 and the second list interconnecting seams 1052 can also be connected together by heat sealing at a time in other embodiment.

The folding units 30 is adapted to be folded, wherein the folding units 30 and the inflatable main body 10 are implemented as two separate parts or implemented as being integrally formed. In the preferred embodiment, the folding units 30 is integrally formed with the inflatable main body 10, wherein the folding units 30 is provided at any desired folding position of the inflatable cells 11, so that the inflatable main body 10 forms a variety of three-dimensional configuration to meet the packaging needs.

In addition, under the action of the folding units 30, the edge of the bottom wall 10*c* and the top wall 10*d* are folded into the corner to form an end support structure so as to facilitate standing of the standing-type air-filled packaging apparatus and the space size of the accommodating cavity 100 is not affected.

Figure 2:
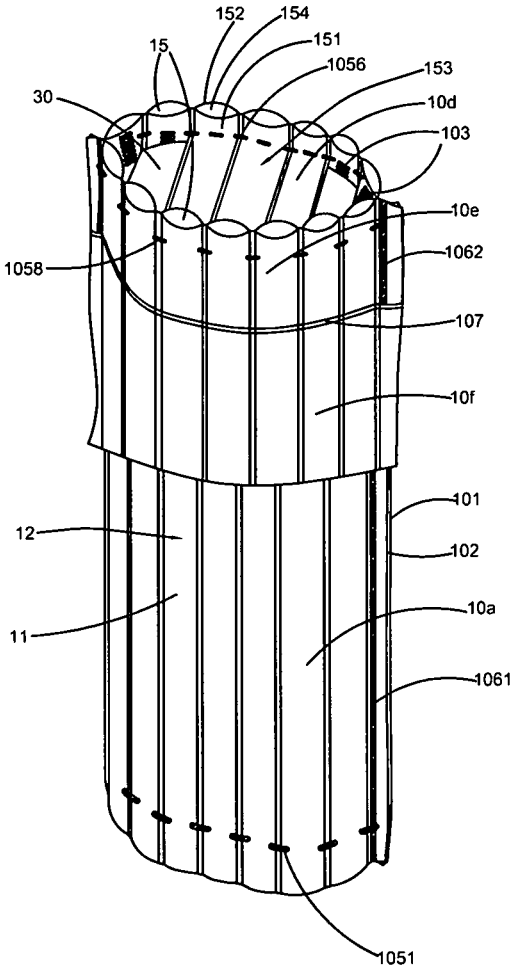
FIG. 2 is a perspective view of the standing-type air-filled packaging apparatus according to the above first preferred embodiment of the present invention, wherein the standing-type air-filled packaging apparatus is folded.
Figure 3:
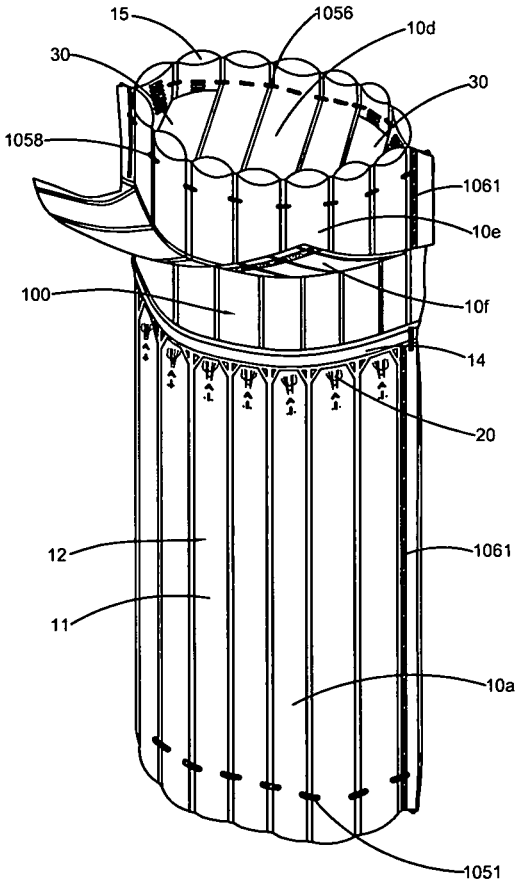
FIG. 3 is a perspective view of the standing-type air-filled packaging apparatus according to the above first preferred embodiment of the present invention, wherein the standing-type air-filled packaging apparatus is folded.
Figure 4:
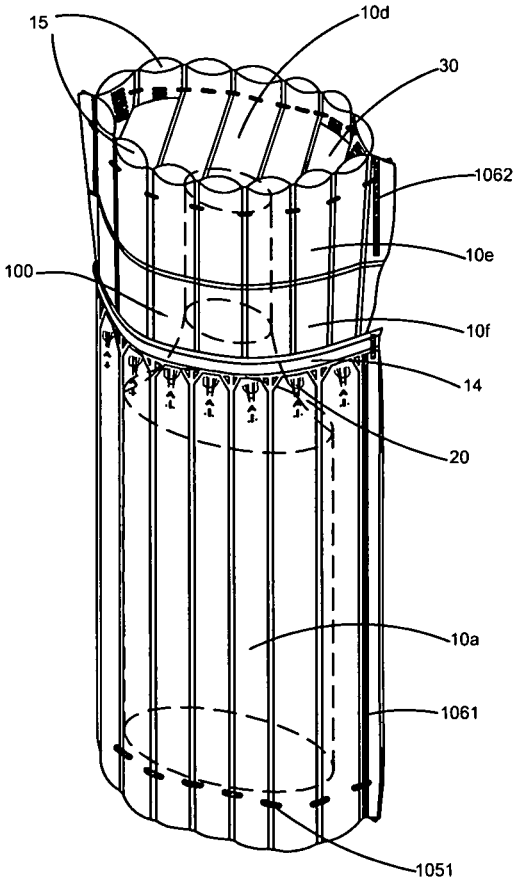
FIG. 4 is a schematic diagram of an application of the standing air packaging apparatus according to above first preferred embodiment of the present invention.

It is worth to be mentioned that, in this embodiment, the supporting section 15 is formed in an approximately circular or elliptical shape, protruding from the bottom wall 10*c* and the top wall 10*d*, and the supporting section 15 has an air cushion so as to support the standing-type air-filled packaging apparatus. When the standing-type air-filled packaging apparatus is placed on the surface of the environment, the bottom end portion of the supporting section 15 is able to support on the surface of the environment in a standing state, thereby realizing the standing function of the standing-type air-filled packaging apparatus of the present invention. As shown in FIG. 1 and FIG. 2 of the drawings, take the top side as an example (the bottom side thereof is of a similar structure), two supporting section 15 shown in FIG. 1 of the present invention form the integral annular support structure on the top side by heat sealing. In other words, the two supporting section 15 form an annular support portion, each of the supporting section 15 comprises two portions which are an inner support portion 151 and an outer support portion 152, the inner support portion 151 and the outer support portion 152 are formed after being folded back and are overlapped with each other. The connecting portion of the inner support portion 151 and the outer support portion 152 forms a annular supporting surface 154, the annular supporting surface 154 is adapted to contact with the surface of the environment, so that the standing-type air-filled packaging apparatus has a standing function. In other words, an entire end side of the prior art is air-filled gas columns, when the air-packing apparatus of the prior art is placed on the environment surface, as the air-filled gas columns have uneven surfaces, the air-packing apparatus of the prior art is not easy to firmly stand. According to this preferred embodiment of the present invention, the annular supporting surface 154 enables the standing-type air-filled packaging apparatus to be more firmly in a standing state.

In addition, as shown in FIG. 2 of the drawings, on the top side of the standing-type air-filled packaging apparatus, the supporting section 15 and the top wall 10*d* form a recessed cushioning chamber 153. It is understandable that the cushioning chamber 153 is also able to be formed on the bottom side of the standing-type air-filled packaging apparatus. When the standing-type air-filled packaging apparatus with the packaged item is placed on the environment surface in the standing state, the bottom side of the package item is not directly contacted with the environment surface, thereby further preventing the packaged item from being impacted by cushioning. Further, even if the packaged item is moved in the accommodating cavity 100, when two ends of the packaged item apply forces on the top wall 10*d* and the bottom wall 10*c*, the top wall 10*d* and the bottom wall 10*c* are deformed in the cushioning chamber 153 and not easily protrude from the cushioning chamber 153 to contact with other environmental items, so that it is further prevented from being damaged by the recoil force of the environmental item.

Preferably, the inflatable cells 11 are longitudinally arranged in the inflatable main body 10, so that each of the inflatable cells 11 is longitudinally aligned after the inflatable main body 10 is folded into a three-dimensional configuration. In the present preferred embodiment, the inflating channel 14 and the air inflating opening 13 are provided on top end of the front side wall 10*a*, the inflating valve 20 is also attached to the top end of the inflatable cells 11 of the front side wall 10*a*.

Further, the inflatable main body 10 comprises a plurality of lists of side sealing lines 106 which are respectively provided on the edges of two sides of the inflatable main body 10 to connect each side walls of the inflatable main body 10 together so as to form the accommodating cavity 100. Preferably, the inflatable main body 10 comprises four lists of side sealing lines 106 and each of the side sealing lines 106 comprises two lists of lower side sealing lines 1061 and two list of upper side sealing lines 1062, wherein the lower side sealing lines 1061 is extended from the top end of the front side wall 10*a* to the middle end of the rear side wall 10*b*, so that two edges of the front side wall 10*a* and two edges of the rear side wall 10*b* are connected together. Moreover, the corner portion of the bottom wall 10*c* is formed in the lower side sealing lines 1061 corresponding to the bottom wall 10*c* after being folded. The upper side sealing lines 1062 is extended from the bottom end of the top wall cover 10*e* to the middle end of the rear side wall 10*b*, and the upper side sealing lines 1062 has a predetermined gap with the lower side sealing lines 1061, so that the top wall cover 10*e* is connected to the rear side wall 10*b*, moreover, the bottom end of the top wall cover 10*e* is connected to the top end of the front side wall 10*a*, thus an opening is formed on the predetermined gap and the corner portion of the top wall 10*d* is formed in the upper side sealing lines 1062 corresponding to the top wall 10*d* after being folded.

It is worth mentioning that the connection method among the side sealing lines 106 can be implemented by heat sealing, wherein the side sealing lines 106 also are able to be implemented as heat sealing lines or a plurality of heat sealing points.

Preferably, the folding units 30 which are provided on the bottom wall 10*c* and the corner portion of the top wall 10*d* are adapted to be folded inward to form a corner support structure of the bottom wall 10*c* and the top wall 10*d* such that the standing-type air-filled packaging apparatus is able to stand.

In other words, in this preferred embodiment of the invention, both ends of the standing-type air-filled packaging apparatus have standing-type support structures. Each of the standing-type support structures comprises an inflatable end wall and the supporting section 15 protruding outwardly from the inflatable end wall. The supporting section 15 and the inflatable end wall form the cushioning chamber 153. The supporting section 15 comprises the inner support portion 151 on the inner side and the outer support portion 152 on the outer side overlapped with the inner support portion 151, and the connection portion thereof is capable of standing on the environmental surface, so that the supporting section 15 provides a supporting function. In this preferred embodiment of the present invention, the inflatable end wall can be implemented as above bottom wall 10*c* and the top wall 10*d*.

Preferably, the inflatable main body 10 further comprises a boundary seams 107 connected the first chamber layer 101 and the second chamber layer 102 by heat sealing, wherein the boundary seams 107 is provided between the top wall cover 10*e* and the plug closing wall 10*f* and prevents the air entered the inflatable cells 11 of the top wall cover 10*e* from entering the plug closing wall 10*f*. In other words, when inflated from the air inflating opening 13, the air enters the front side wall 10*a*, the rear side wall 10*b*, the bottom wall 10*c*, the top wall 10*d* and the top wall cover 10*e* instead of entering the plug closing wall 10*f*. When the inflatable main body 10 is folded, the non-inflated plug closing wall 10*f* is more easily inserted into the accommodating cavity 100 and does not affect the size of the accommodating cavity 100. If the plug closing wall 10*f* is inflated, when the bottle is packaged into the accommodating cavity 100, the inflated plug closing wall 10*f* is not easy to be inserted into the accommodating cavity 100, or even if the bottle is forced to insert the accommodating cavity 100, as too much space is occupied, the bottle may be skewed. Therefore, the boundary seams 107 can satisfactorily solve the inflation problem of the plug closing wall 10*f*. In other embodiment, the boundary seams 107 not completely make the plug closing wall 10*f* uninflated, but to reduce the amount of inflation so that the plug closing wall 10*f* forms a small chamber inflatable wall.

The standing-type air-filled packaging apparatus according to the preferred embodiment of the present invention is suitable for packaging a cylindrical product such as a red wine bottle, a beer bottle, a lamp or the like which is capable of standing in the accommodating cavity 100, the standing-type air-filled packaging apparatus not only protects the packaged items, but also increases the beauty.

Figure 5:
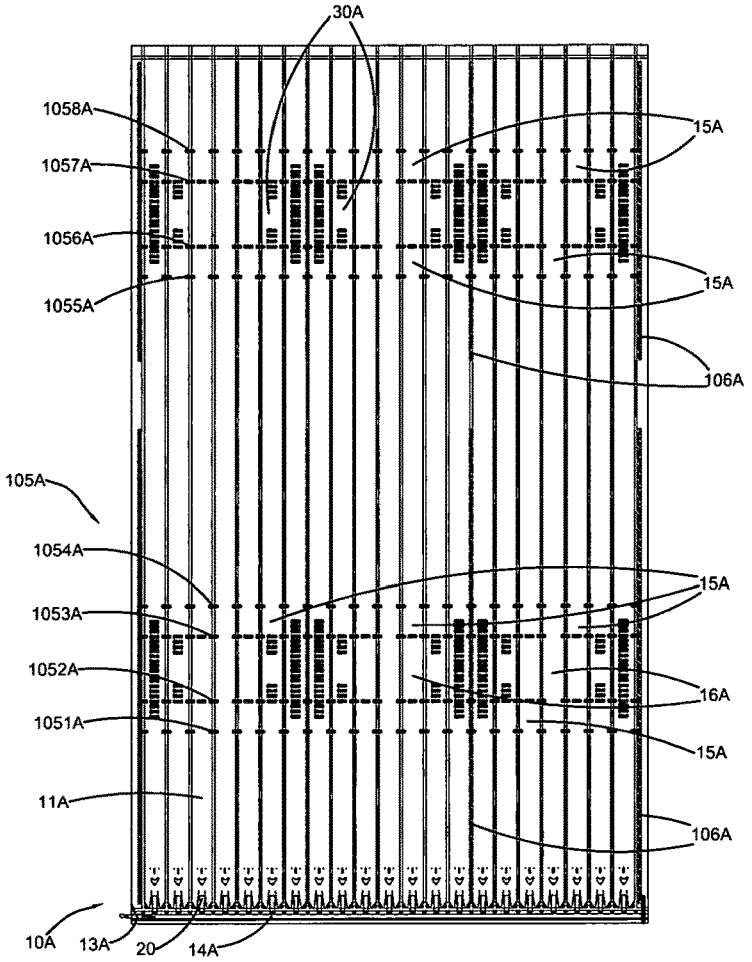
FIG. 5 is a schematic view of the standing-type air-filled packaging apparatus according to an alternative mode of the first preferred embodiment of the present invention, wherein the standing-type air-filled packaging apparatus is not inflated and is unfolded.
Figure 6:
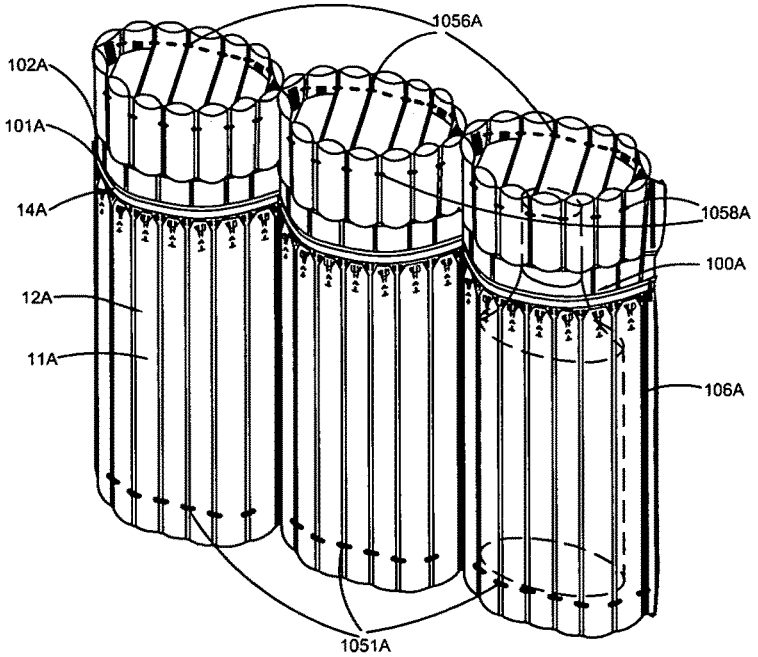
FIG. 6 is a perspective view of the standing-type air-filled packaging apparatus according to the alternative mode of the above first preferred embodiment of the present invention, wherein the standing-type air-filled packaging apparatus is folded.
Figure 7:
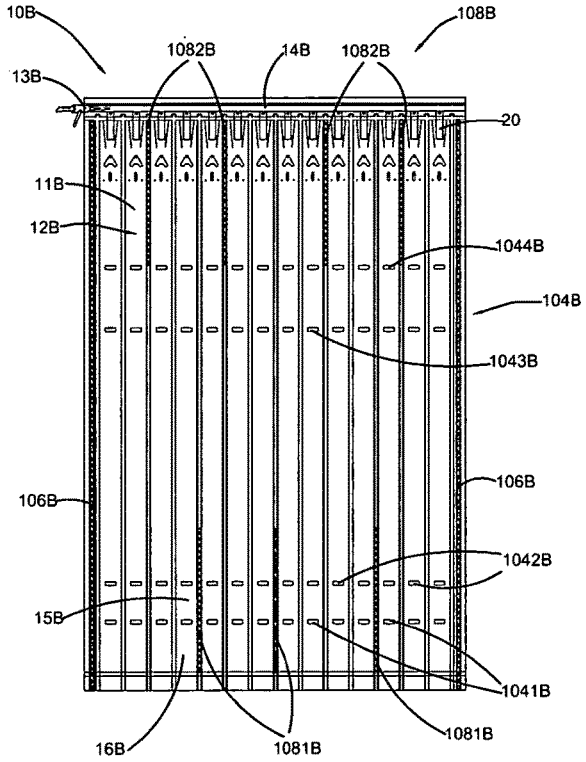
FIG. 7 is a perspective view of the standing-type air-filled packaging apparatus according to a second preferred embodiment of the present invention, wherein the standing-type air-filled packaging apparatus is not inflated and is unfolded.
Figure 8:
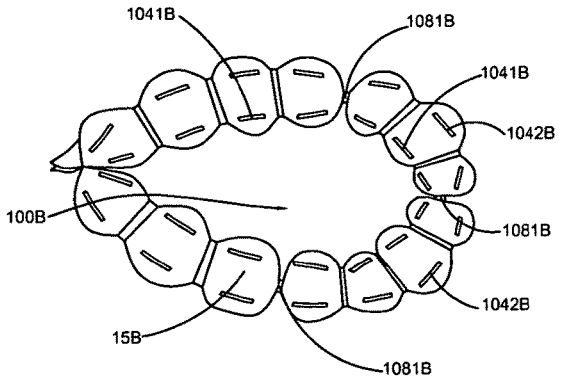
FIG. 8 is a perspective view of the standing-type air-filled packaging apparatus according to the second preferred embodiment of the present invention, illustrating the bottom structure of the standing-type air-filled packaging apparatus after being folded.
Figure 9:
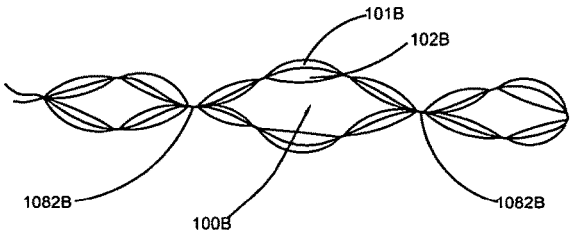
FIG. 9 is a perspective view of the standing-type air-filled packaging apparatus according to the second preferred embodiment of the present invention, illustrating the bottom structure of the standing-type air-filled packaging apparatus after being folded.
Figure 10:
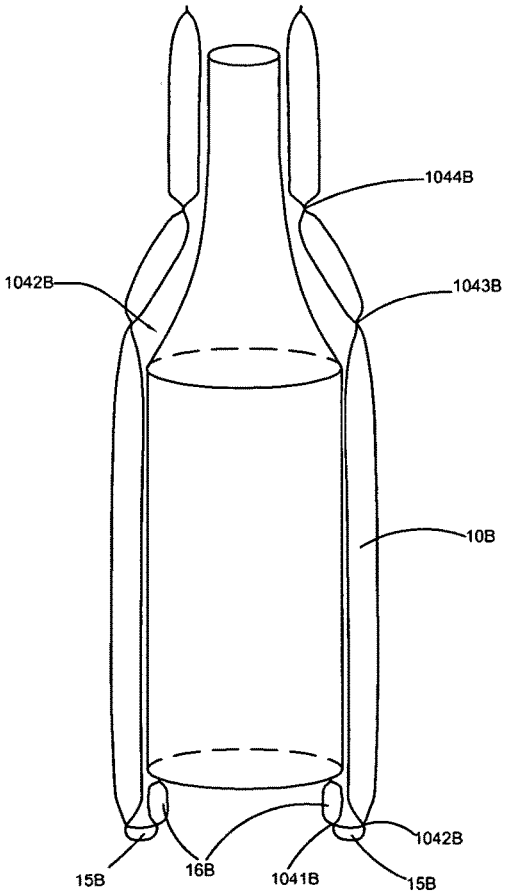
FIG. 10 is a perspective view of the standing-type air-filled packaging apparatus according to the second preferred embodiment of the present invention, illustrating the side portion of the standing-type air-filled packaging apparatus after being folded.
Figure 11:
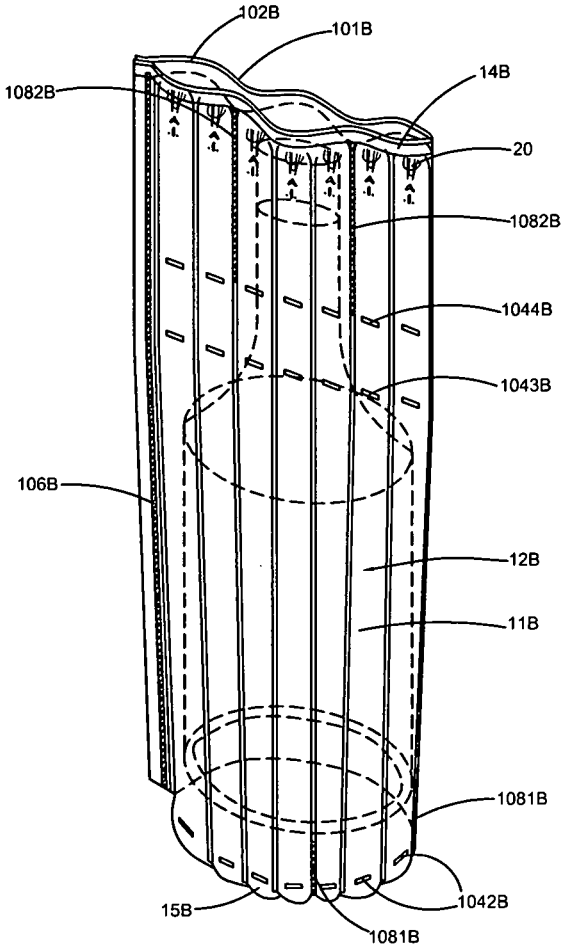
FIG. 11 is a schematic diagram of an application of the standing air packaging apparatus according to above second preferred embodiment of the present invention.
Figure 12:
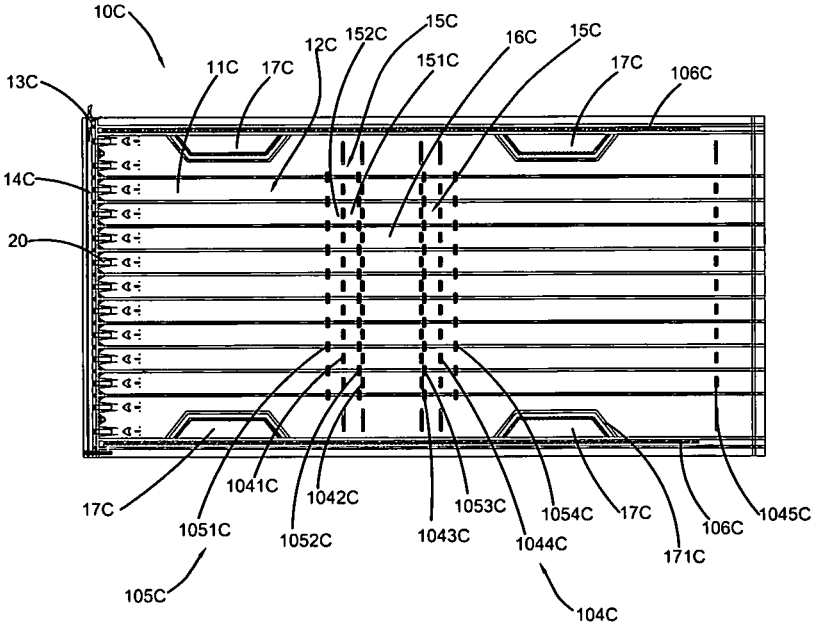
FIG. 12 is a perspective view of the standing-type air-filled packaging apparatus according to a third preferred embodiment of the present invention, wherein the standing-type air-filled packaging apparatus is not inflated and is unfolded.
Figure 13:
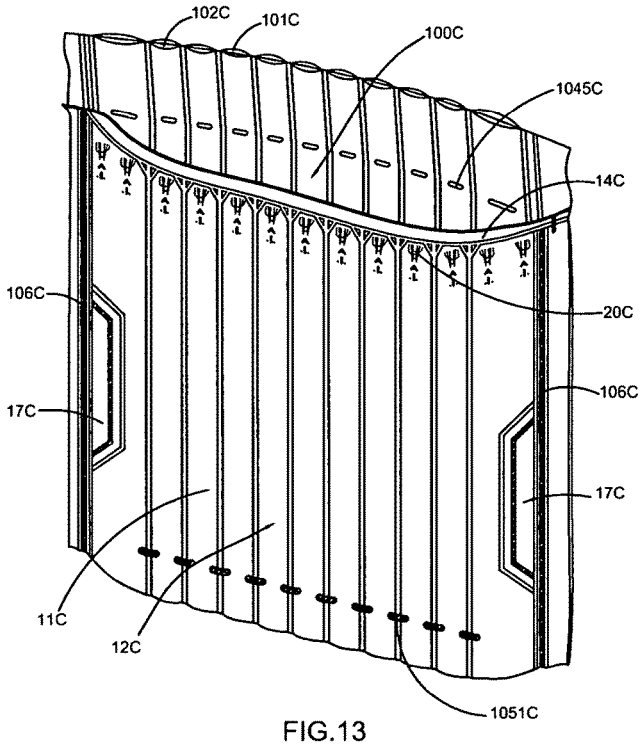
FIG. 13 is a perspective view of the standing-type air-filled packaging apparatus according to the third preferred embodiment of the present invention after being folded.
Figure 14:
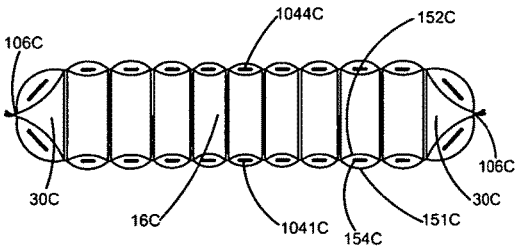
FIG. 14 is a perspective view of the standing-type air-filled packaging apparatus according to the third preferred embodiment of the present invention, illustrating the bottom structure of the standing-type air-filled packaging apparatus after being folded.

Referring to FIG. 5 and FIG. 6 of the drawings, the standing-type air-filled packaging apparatus according to an alternative mode of the first preferred embodiment is illustrated. As shown in FIG. 5 and FIG. 6 of the drawings, based on the above first preferred embodiment, in this embodiment, a plurality of the inflatable main body 10 are engaged together to form an inflatable main body 10A. The inflatable main body 10A forms the standing-type air-filled packaging apparatus which is capable of accommodating a plurality of the items to be packaged.

The inflatable main body 10A comprises a first chamber layer 101A and a second chamber layer 102A which are overlapped with each other to form an inflatable cells 11A, an inflatable cavity 12A, an air inflating opening 13A and a inflating channel 14A, wherein the air inflating opening 13A is connected to an air pump and feeds the air into the inflating channel 14A so as to distribute the air into each of the inflatable cavity 12A, so that the inflatable cells 11A is inflated, thereby the inflatable main body 10A having an air cushioning effect.

According to the embodiment, the inflatable main body 10A after being folded is capable of accommodating three items to be packaged, wherein the inflatable main body 10A amounts to three sub-inflatable cells. Preferably, the three sub-inflatable cells integrally form the inflatable main body 10A and further form three accommodating cavity 100A. Each of the accommodating cavities 100A is opened and closed individually and is adapted to individually accommodate the item to be packaged for individually protection. Wherein each of the sub-inflatable cells of each of the accommodating cavity 100A is the same as the inflatable main body 10 in the first preferred embodiment described above, by connecting the side edges sequentially to form the inflatable main body 10A, and then the standing-type air-filled packaging apparatus which is capable of accommodating three items to be packaged is formed after being parallel folded.

The inflatable main body 10A comprises a plurality of lists of side sealing lines 106A, wherein the side sealing lines 106A are longitudinally disposed between adjacent sub-inflatable cells. When the inflatable main body 10A is folded, the side sealing lines 106A which are in the same column are bonded together to form each of the accommodating cavity 100A and each of the accommodating cavity 100A are separated from each other. It is worth mentioning that two columns of the side sealing lines 106A are provided on two sides of the sub-inflatable cells in the middle so as to form three accommodating cavity 100A after the inflatable main body 10A being folded. Moreover, as the side sealing lines 106A is thin enough, not only different portions of the inflatable main body 10A are sealed, but also the air cushioning performance is not affected after being folded, so that the items packaged in the different accommodating cavity 100A have air cushioning performance with each other and are prevented from colliding with each other, thereby protecting the items to be packaged in a better manner.

The inflatable main body 10A is provided with a plurality of lists of interconnecting seams 105A which are which are arranged in a lateral direction and spaced apart from each other. Two adjacent lists of the interconnecting seams 105A are connected with each other to form four supporting section 15A. Specifically, a first list interconnecting seams 1051A and a second list interconnecting seams 1052A are connected to form one of the supporting section 15A, a third list interconnecting seams 1053A and a fourth list interconnecting seams 1054A are connected to form one of the supporting section 15A. The sub-inflatable cells between the second list interconnecting seams 1052A and the third list interconnecting seams 1053A form a bottom wall 16A. The supporting section 15A at the bottom is elliptical around the bottom wall 16A and the supporting section 15A and the bottom wall 16A are in two planes. In other words, the supporting section 15A is protruded from the bottom wall 16A and the supporting section 15A has air cushioning performance such that the standing-type air-filled packaging apparatus firmly stand. A fifth list interconnecting seams 1055A and a sixth list interconnecting seams 1056A are connected and a seventh list interconnecting seams 1057A and a eighth list interconnecting seams 1058A are connected so as to form other two supporting section 15A and a top wall to support the standing-type air-filled packaging apparatus.

It is understandable that the formed three accommodating cavities 100A of the inflatable cells 11A according to this embodiment are exemplary only. One skilled in the art will envision other modifications, and design two or more than three accommodating cavities 100A to pack more items.

The standing-type air-filled packaging apparatus according to this embodiment can satisfy the requirement that the user simultaneously packs a plurality of items such as a plurality of bottles of red wine, beer, beverage, milk and the like. If users purchase or transport a plurality of objects at the same time and are able to use fewer bags to meet the demand, to cost savings, and to reduce the use of space.

Referring to FIG. 7 to FIG. 11 of the drawings, the standing-type air-filled packaging apparatus according to a second preferred embodiment of the present invention is illustrated. As shown in FIG. 7 to FIG. 11 of the drawings, the standing-type air-filled packaging apparatus is adapted for packaging cylindrical items such as bottles, which are preferably bottles having a bottleneck smaller than a bottle body thereof, and both the bottleneck and the bottle body are cylinders. The standing-type air-filled packaging apparatus after being folded forms the same shape with the bottle so as to firmly enclose the bottle within the standing-type air-filled packaging apparatus. In other words, the standing-type air-filled packaging apparatus after being folded has a matched shape with the shape of the bottle so as to tightly wrapped around the outside of the bottle.

In the preferred embodiment, at least one inflating valve 20 is mounted to an inflatable main body 10B, the inflatable main body 10B is inflated by an air pump to have air cushioning performance and is adapted for protecting the packaged items.

The inflatable main body 10B is formed by a first chamber layer 101B overlapping with a second chamber layer 102B, wherein the first chamber layer 101B and the second chamber layer 102B are overlapped with each other to form at least one inflatable cells 11B, at least one inflatable cavity 12B, an air inflating opening 13B and a inflating channel 14B. Each of the inflatable cavities 12B is communicated with the inflating channel 14B and the air inflating opening 13B. The inflating valve 20 is mounted to each of the inflatable cavity 12B so as to inflate the inflatable main body 10B, so that the inflatable main body 10B has air cushioning performance.

Preferably, the inflatable main body 10B is divided into a plurality of the inflatable cells 11B by a plurality of dividing seams 103B, each of the inflatable cells 11B is independent with each other, if one of the inflatable cells 11B is damaged, the air cushioning performance of other inflatable cells 11B is not affected.

The inflatable main body 10B comprises a plurality of lists of folding seams 108B, wherein the folding seams 108B are longitudinally disposed at the upper and lower ends of the inflatable main body 10B and are respectively positioned at the heat sealing line between two inflatable cells 11B, wherein the lower portion of the inflatable main body 10B comprises three lists of lower folding seams 1081B which are extended from the bottom portion of the inflatable main body 10B to the middle portion of the inflatable main body 10B. The upper portion of the inflatable main body 10B comprises four lists of upper folding seams 1082B which are extended from the inflating channel 14B to the middle portion of the inflatable main body 10B. It is worth to be noted that as the upper folding seams 1082B is provided, the upper end of the inflatable main body 10B is easy to be pressed in such a manner that the space formed by the upper end of the inflatable main body 10B is smaller than the space formed by the lower end of the inflatable main body 10B, so that the upper end of the 108 is fit to the bottleneck of the packaged bottle to closely contacting the bottleneck, thereby the package being more tightly. Moreover, as the lower folding seams 1081B is provided, the bottom portion of the inflatable main body 10B is adapted to be folded to form a relative steady bottom wall 16B and to form obstacle on the bottom portion of the accommodating cavity 100B, thereby preventing the items to be packaged from slipping out the accommodating cavity 100B.

It is worth mentioning that as the upper folding seams 1082B and the lower folding seams 1081B are provided, the lateral dimension of the standing-type air-filled packaging apparatus is changed such that the standing-type air-filled packaging apparatus is affixed to the items to be packaged.

The heat sealing line between the folding seams 108B and the inflatable cells 11B is integrally formed. In other words, the folding seams 108B can be implemented by heat sealing.

The inflatable main body 10B comprises four lists of bending seams 104B, wherein the first chamber layer 101B and the second chamber layer 102B are heat-sealed by the bending seams 104B, so that the inflatable main body 10B is easily folded to form the standing-type air-filled packaging apparatus, wherein a first list bending seams 1041B, a second list bending seams 1042B, a third list bending seams 1043B and a fourth list bending seams 1044B are successively provided from the lower end of the inflatable main body 10B to the upper end of the inflatable main body 10B.

The first list bending seams 1041B and the second list bending seams 1042B are laterally disposed at the lower end of the inflatable main body 10B, the inflatable main body 10B are laterally bent to form the bottom of the standing-type air-filled packaging apparatus along the first list bending seams 1041B and the second list bending seams 1042B, wherein the sub-inflatable cells between the first list bending seams 1041B and the second list bending seams 1042B form a supporting section 15B, wherein the supporting section 15B is formed in an oval shape to support the standing-type air-filled packaging apparatus and to have air cushioning performance, so that the standing-type air-filled packaging apparatus is capable of steadily standing and the items to be packaged are well protected.

It is worth mentioning that as the first list bending seams 1041B and the second list bending seams 1042B are provided, the lower portion of the inflatable main body 10B is bent to form the bottom portion of the standing-type air-filled packaging apparatus. Meanwhile, the bottom portion of the standing-type air-filled packaging apparatus is easy to be opened by hands, when the bottom portion thereof is opened, the bottles can be put into the standing-type air-filled packaging apparatus, then the lower portion of the inflatable main body 10B is folded to form the bottom portion of the standing-type air-filled packaging apparatus along the first list bending seams 1041B and the second list bending seams 1042B, so that the bottle steadily stand in the standing-type air-filled packaging apparatus. The first list bending seams 1041B and the second list bending seams 1042B make the bottom portion of the standing-type air-filled packaging apparatus easy to be folded and to be stretched such that the standing-type air-filled packaging apparatus is opened to place and remove the items to be packaged, meanwhile, the standing-type air-filled packaging apparatus is capable of steadily standing.

The third list bending seams 1043B and the fourth list bending seams 1044B are provided on the upper portion of the inflatable main body 10B, so that the inflatable main body 10B is adapted to be bent along the third list bending seams 1043B and the fourth list bending seams 1044B. After being bent, the sub-inflatable cells between the third list bending seams 1043B and the fourth list bending seams 1044B are attached to the bottle. For a cylindrical bottle, particularly red wine bottles and beer bottles, the bottle body and the bottleneck are cylindrical. A bottle shoulder is provided on the joint of the bottle body and the bottleneck and has a decreased diameter from the bottle body to the bottleneck. The inflatable main body 10B is laterally bent along the third list bending seams 1043B and the fourth list bending seams 1044B, so that an inclined angle portion is formed on the upper portion and the lower portion of the inflatable main body 10B and has a similar shape with the shape of the bottle. When the inflatable main body 10B is bent along the third list bending seams 1043B and the fourth list bending seams 1044B, the sub-inflatable cells between the third list bending seams 1043B and the fourth list bending seams 1044B are bent to fit to the shape of the bottle shoulder, so that the inflatable main body 10B is tightly contacting to the bottle shoulder of the bottle so as to prevent the bottle from shaking and the bottle is well protected.

It is worth mentioning that as the upper folding seams 1082B is provided, the inflatable main body 10B has a lateral pressing force, so that the upper portion of the inflatable main body 10B has a smaller size than the lower portion of the inflatable main body 10B. In other words, four lists of the upper folding seams 1082B are evenly and equally distributed in the inflatable main body 10B. When the inflatable main body 10B is folded, the upper folding seams 1082B are respectively arranged on the front portion and the rear portion of the standing-type air-filled packaging apparatus, wherein the upper folding seams 1082B arranged on the front portion is bonded to the upper folding seams 1082B arranged on the rear portion, so that the upper portion of the standing-type air-filled packaging apparatus forms three small accommodating cavity. The size of the middle accommodating cavity is fit to the size of the bottle shoulder of the bottle, so that the upper portion of the standing-type air-filled packaging apparatus is tightly attached to the bottle shoulder of the bottle, thereby preventing the bottle from shaking and protecting the bottle.

Further, the inflatable main body 10B comprises two side sealing lines 106B longitudinally provided on both sides of the inflatable main body 10B, so that two sides of the inflatable main body 10B are connected to form an accommodating cavity 100B to accommodate the items to be packaged, wherein the connection of the two sides of the inflatable main body 10B is either by heat sealing or other bonding connection to fix the inflatable main body 10B.

It is worth to be mentioning that the top portion of the standing-type air-filled packaging apparatus is either closed or not closed. Preferably, the top portion of the standing-type air-filled packaging apparatus is enclosed so as to well protect the items to be packaged and to prevent the debris or the like from entering the accommodating cavity 100B.

Referring to FIG. 12 to FIG. 15 of the drawings, the standing-type air-filled packaging apparatus according to a third preferred embodiment of the present invention is illustrated. As shown in FIG. 12 to FIG. 15 of the drawings, the standing-type air-filled packaging apparatus comprises an inflatable main body 10C, at least one inflating valve 20, wherein the inflating valve 20 is mounted to the inflatable main body 10C and the inflatable main body 10C is inflated by an air pump to have air cushioning performance.

The inflatable main body 10C is formed by a first chamber layer 101C overlapping with a second chamber layer 102C, wherein the first chamber layer 101C and the second chamber layer 102C are overlapped with each other to form at least one inflatable cells 11C, at least one inflatable cavities 12C, an air inflating opening 13C and a inflating channel 14C. Each of the inflatable cavities 12C is communicated with the inflating channel 14C and the air inflating opening 13C. The inflating valve 20 is mounted to each of the inflatable cavities 12C so as to inflate the inflatable main body 10C, so that the inflatable main body 10C has air cushioning performance.

Further, the inflatable main body 10C further comprises a plurality of lists of bending seams 104C, wherein the bending seams 104C are spaced apart from each other in the inflatable main body 10C, the inflatable main body 10C is bent around the bending seams 104C to form a stable bottom structure to support the standing-type air-filled packaging apparatus, thereby the standing-type air-filled packaging apparatus is adapted to steadily stand.

As an example, the bending seams 104C comprises a first list bending seams 1041C, a second list bending seams 1042C, a third list bending seams 1043C and a fourth list bending seams 1044C, wherein the first list bending seams 1041C and the third list bending seams 1043C are bent to form a bottom wall 16C, wherein when the inflatable main body 10C is unfolded, the bottom wall 16C is formed by the middle portion of the inflatable main body 10C, when the inflatable main body 10C is folded, the bottom wall 16C is formed as the bottom wall on the bottom of the standing-type air-filled packaging apparatus.

The inflatable main body 10C further comprises a plurality of lists of interconnecting seams 105C. For example, according to the embodiment, the interconnecting seams 105C comprises a first list interconnecting seams 1051C, a second list interconnecting seams 1052C, a third list interconnecting seams 1053C and a fourth list interconnecting seams 1054C, wherein the first list interconnecting seams 1051C and the second list interconnecting seams 1052C are respectively provided on two sides of the first list bending seams 1041C, the third list interconnecting seams 1053C and the fourth list interconnecting seams 1054C are respectively provided on two sides of the third list bending seams 1043C, thus a supporting section 15C is formed on two sides of the bottom wall 16C to support the standing-type air-filled packaging apparatus, thereby the standing-type air-filled packaging apparatus steadily standing.

Figure 15:
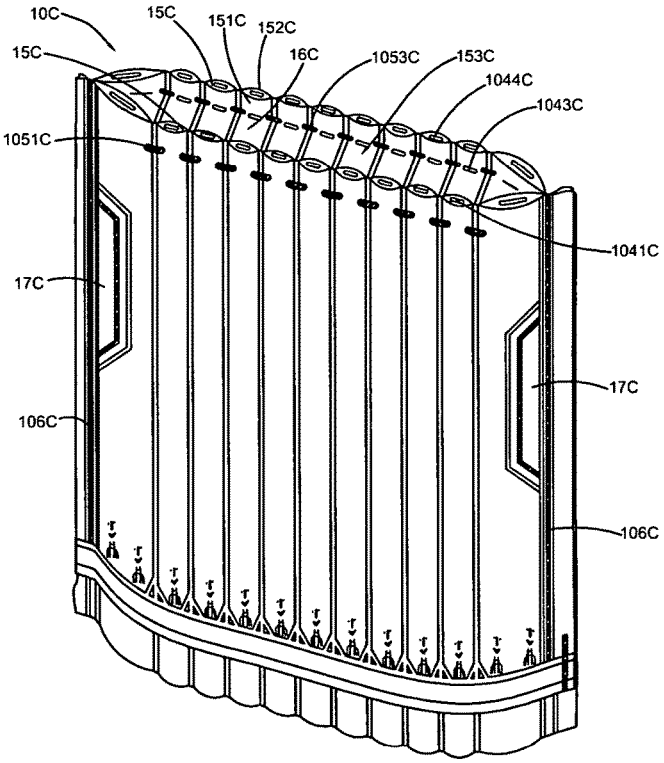
FIG. 15 is a perspective view of the standing-type air-filled packaging apparatus according to the above third preferred embodiment of the present invention after being folded.

The inflatable main body 10C is bent along the first list bending seams 1041C and the fourth list bending seams 1044C, the first list interconnecting seams 1051C and the second list interconnecting seams 1052C are connected such as by heat sealing in one process, or the first list interconnecting seams 1051C and the second list interconnecting seams 1052C are integrally connected in the heat sealing process and form a first supporting portion 151C. Similarly, the third list interconnecting seams 1053C and the fourth list interconnecting seams 1054C are connected such as by heat sealing in one process, or the third list interconnecting seams 1053C and the fourth list interconnecting seams 1054C are integrally connected in the heat sealing process and form a second supporting portion 152C, wherein two ends of the first supporting portion 151C is connected with two ends of the second supporting portion 152C, and are provided around the bottom wall 16C, thereby forming the whole supporting structure and achieving the standing performance of the standing-type air-filled packaging apparatus. As shown in FIG. 15 of the drawings, two sides of the bottom wall 16C respectively form a front supporting section 15C and a rear supporting section 15C. Preferably, after being folded, the first list bending seams 1041C is positioned on the middle of the first supporting portion 151C, the fourth list bending seams 1044C is provided on the middle of the second supporting portion 152C; after packaging the items, external force can be uniformly distributed between the front and rear supporting section 15C and the bottom wall 16C, thereby the standing-type air-filled packaging apparatus standing steadily and being easy to stand on flat surface such as the ground. In other words, the middle portion of each of the supporting section 15C forms a list of the first list bending seams 1041C or fourth list bending seams 1044C such that the supporting section 15C is easy to be folded back to form two overlapped portion.

It is worth mentioning that the second list bending seams 1042C is disposed adjacent to the second list interconnecting seams 1052C, so that the second list interconnecting seams 1052C and the first list interconnecting seams 1051C which are connected are easy to be formed. The third list bending seams 1043C is disposed adjacent to the third list interconnecting seams 1053C, so that the third list interconnecting seams 1053C and the fourth list interconnecting seams 1054C which are connected are easy to be formed. Moreover, the providing of the second list interconnecting seams 1052C and the third list interconnecting seams 1053C make the bottom wall 16C more steadily. In other embodiment, the second list bending seams 1042C and the third list bending seams 1043C can also not be provided.

Each of supporting section 15C respectively is divided into two portions which are an inner portion 151C and an outer portion 152C communicated with each other. The sub-inflatable cells are formed the connecting portion of the inner portion 151C and the outer portion 152C, when the standing-type air-filled packaging apparatus is in the standing state, the connecting portion stands and contacts the environmental surface. The first list bending seams 1041C and the fourth list bending seams 1044C can be provided in the middle of the inflatable cells 11C or provided on two sides of the inflatable cells 11C similar to the interconnecting seams 105C under the condition that the inflatable cells 11C along the width direction is communicated. In other words, the adjacent bending seams are spaced or the bending seams are spaced with adjacent dividing seams 103C. In other embodiment, the bending seams can also not be provided similar to the first embodiment. In this preferred embodiment, the interconnecting seams 105C connects the inflatable main body 10C and the second chamber layer 102C by heat sealing and the position of the interconnecting seams 105C is transversely across the dividing seams 103C, similarly forming a cross-shaped shape. In other alternative mode of the present invention, the interconnecting seams 105C is formed in the middle position of the inflatable cells 11C along width direction, similarly to the bending seams shown in the drawings.

In the preferred embodiment, after folding, the supporting section 15C and the bottom wall 16C are located on two planes, each of the supporting section 15C is protruded from the bottom wall 16C and encloses to form a similar circular or elliptical structure. Moreover, the bottom wall 16C and the supporting section 15C form a recessed cushioning chamber 153C, so that the end support structure facilitates the standing function of the standing-type air-filled packaging apparatus.

Further, the inflatable main body 10C further comprises two side sealing lines 106C which are respectively provided on both sides of the inflatable main body 10C. When the inflatable main body 10C is folded, two lists of the side sealing lines 106C are bonded such that the inflatable main body 10C forms an accommodating cavity 100C to package items to be packaged. In order to make the inflatable main body 10C stand more stable, two holding portion 17C are spaced arranged on each sides of the inflatable main body 10C respectively. The partially portions of the inflatable cells 11C of the front and rear wall are heat sealed by a sealing line 171C, thereby preventing the holding portion 17C from being inflated and forming the holding portion 17C which is not inflated to facilitate the grip of the user.

A fifth list bending seams 1045C is provided at the rear end of the rear wall of the inflatable main body 10C, so that the rear end of the rear wall of the inflatable main body 10C is easily bent to form a cover of the accommodating cavity 100C for facilitating opening or closing. After the standing-type air-filled packaging apparatus is placed in the packaging box, the cover is pressed by the pressure of the packing box to close the accommodating cavity 100C, thereby preventing the package to be packaged from slipping out.

In this preferred embodiment of the present invention, the standing-type air-filled packaging apparatus forms a generally U-shaped package bag. The inflatable cells 11C which is integrally connected is folded and both sides are heat-sealed together to form the accommodating cavity 100C and the support structure having the supporting section 15C and the bottom wall 16C on the bottom side. The supporting section 15C and the bottom wall 16C are integrally connected and formed by partial potion of the inflatable cells 11C, and the supporting section 15C and the bottom wall 16C form the cushioning chamber 153C for generating deformation of the bottom wall 16C, thereby preventing the items contained in the accommodating cavity 100C from being subjected to greater end impact stress.

Figure 16:
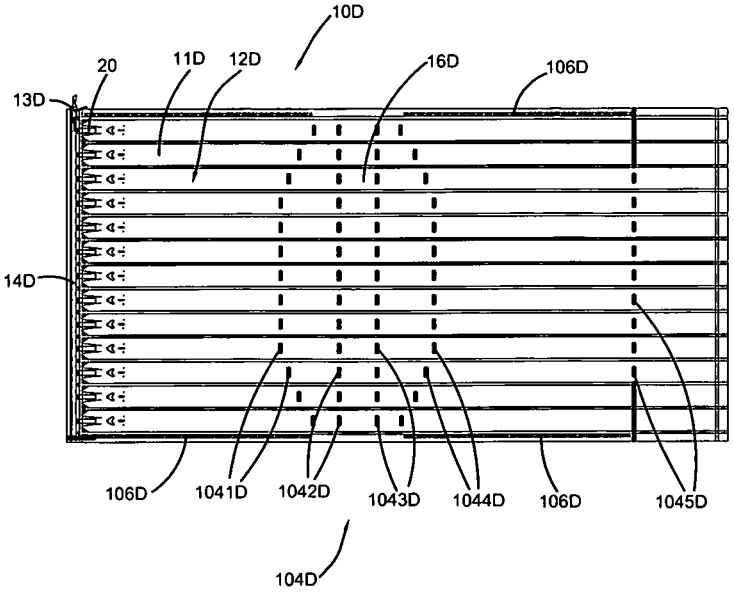
FIG. 16 is an exploded view of an alternative mode of a standing-type air-filled packaging apparatus according to the third preferred embodiment of the present invention, wherein the standing-type air-filled packaging apparatus is not inflated and is unfolded.
Figure 17:
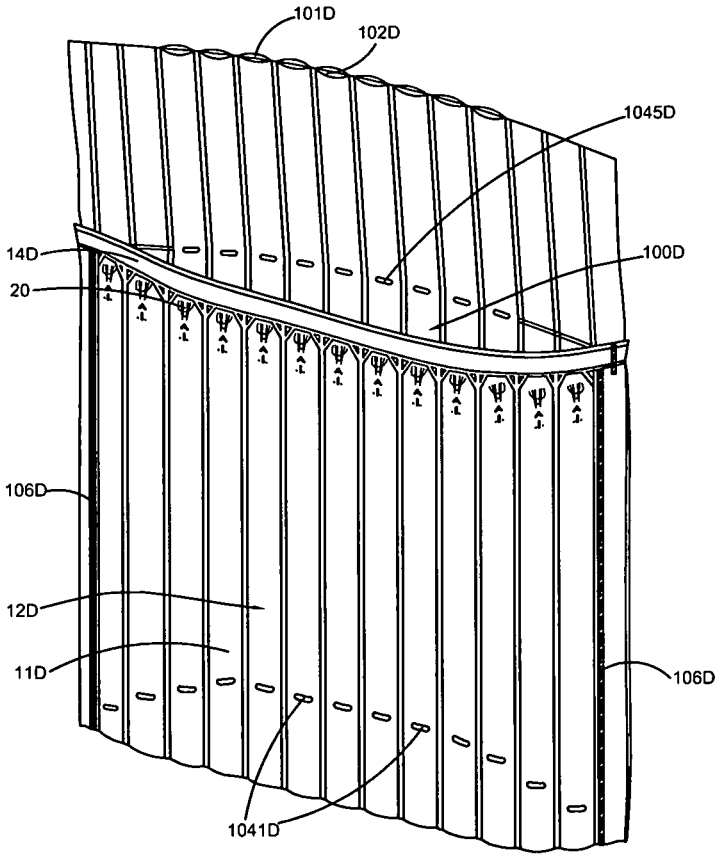
FIG. 17 is a perspective view of the standing-type air-filled packaging apparatus according to the alternative mode of the above third preferred embodiment of the present invention after being folded.
Figure 18:
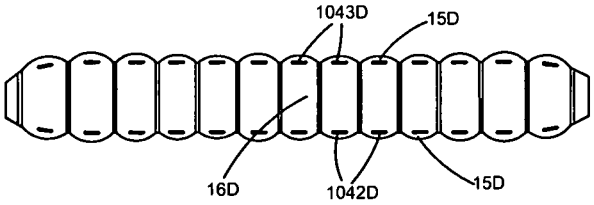
FIG. 18 is a schematic view of the standing-type air-filled packaging apparatus according to the alternative mode of the third preferred embodiment of the present invention, illustrating the bottom structure of the standing-type air-filled packaging apparatus.
Figure 19:
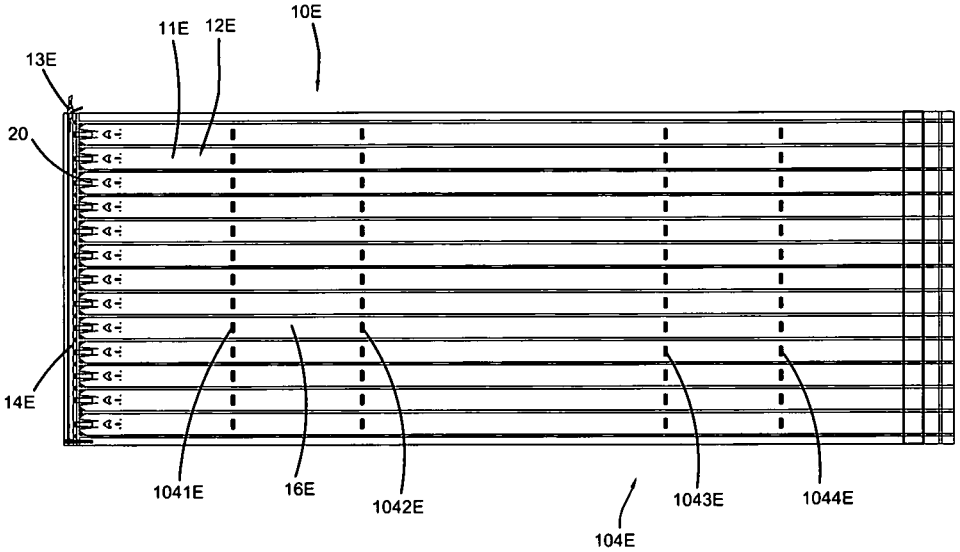
FIG. 19 is an exploded view of an alternative mode of a standing-type air-filled packaging apparatus according to a fourth preferred embodiment of the present invention, wherein the standing-type air-filled packaging apparatus is not inflated and is unfolded.
Figure 20:
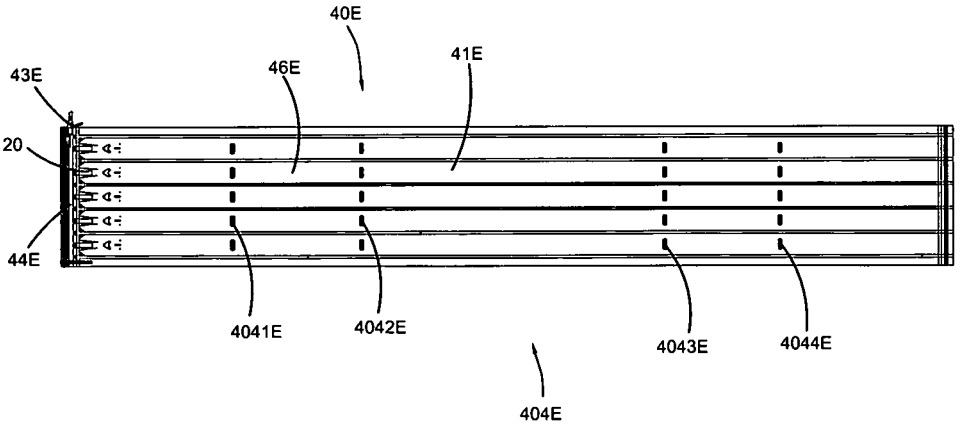
FIG. 20 is an exploded view of an alternative mode of a standing-type air-filled packaging apparatus according to the fourth preferred embodiment of the present invention, wherein side inflated cells of the standing-type air-filled packaging apparatus are not inflated.
Figure 21:
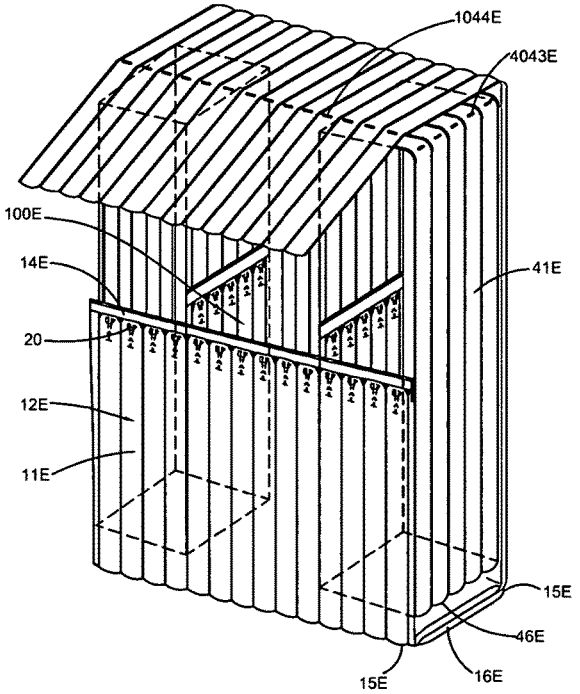
FIG. 21 is a perspective view and application of the standing-type air-filled packaging apparatus according to the fourth preferred embodiment of the present invention after being folded.
Figure 22:
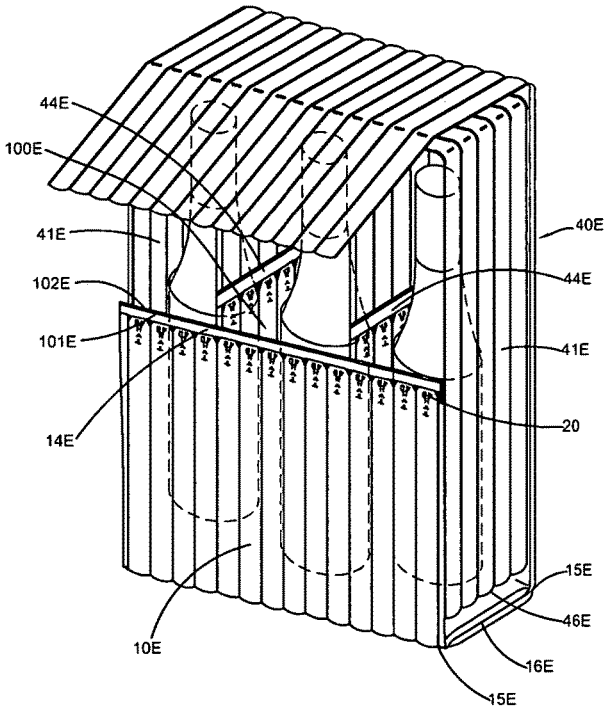
FIG. 22 is a perspective view and application of the standing-type air-filled packaging apparatus according to the fourth preferred embodiment of the present invention after being folded.

Referring to FIG. 16 to FIG. 18 of the drawing, the standing-type air-filled packaging apparatus according to an alternative mode of the third embodiment of the present invention is illustrated. As shown in FIG. 16 to FIG. 18 of the drawings, the standing-type air-filled packaging apparatus comprises an inflatable main body 10D and at least one inflating valve 20. The inflatable main body 10D comprises at least one inflatable cells 11D, wherein the inflating valve 20 is provided on the inflatable cells 11D of the inflatable main body 10D and the inflatable cells 11D is inflated by the inflating valve 20, thereby the inflatable main body 10D having air cushioning performance.

The inflatable main body 10D comprises a first chamber layer 101D and a second chamber layer 102D which are overlapped with each other to form at least one inflatable cells 11D, wherein the first chamber layer 101D and the second chamber layer 102D are overlapped with each other to form at least one inflatable cavity 12D, an air inflating opening 13D and an inflating channel 14D, wherein the air inflating opening 13D is communicated with the inflating channel 14D, the inflating channel 14D communicates with the 12D to inflate the inflatable cells 11D. Each of the inflatable cells 11D can be implemented by heat sealing; the inflatable cavity 12D is divided into a plurality of independent inflatable cavities, and the air inflating opening 13D is mounted to an inflatable nozzle of an external air pump so as to distribute the air into each of the inflatable cells 11D via the inflating channel 14D, so that the inflatable main body 10D has an air cushioning effect.

In the specific embodiment, the inflatable main body 10D comprises five lists of bending seams 104D in which the second list bending seams 1042D and the third list bending seams 1043D are provided in the middle of the inflatable main body 10D to form a bottom wall 16D, wherein the bottom wall 16D is the bottom wall of the standing-type air-filled packaging apparatus. The first list bending seams 1041D and the fourth list bending seams fourth list bending seams 1044E are respectively provided in the front and rear walls of the standing-type air-filled packaging apparatus and are located on both sides of the second list bending seams 1042D, wherein the first list bending seams 1041D and the fourth list bending seams fourth list bending seams 1044E are arranged in an arc shape, so that both sides of the standing-type air-filled packaging apparatus are easily connected and are easily stably stand after connection.

The inflatable main body 10D further comprises a plurality of lists of side sealing lines 106D, wherein the side sealing lines 106D respectively are provided on both sides of the inflatable main body 10D to connect the sides of the inflatable main body 10D so as to form an accommodating cavity 100D accommodating the package to be packaged.

It is worth mentioning that the side sealing lines 106D on each side extends from the middle of the inflatable main body 10D to two ends of the inflatable main body 10D, wherein the end portions in the middle of the side sealing lines 106D respectively corresponds to the first list bending seams 1041D and the fourth list bending seams fourth list bending seams 1044E. In other words, the portions of the inflatable main body 10D which are corresponding to the first list bending seams 1041D and the fourth list bending seams fourth list bending seams 1044E are not bonded while being folded, and the other portions of the side portions are bonded together. After the side sealing lines 106D of the front wall and the rear wall are connected, the middle portion of the inflatable main body 10D is not connected to form a steadily bottom wall 16D. Bending around the second list bending seams 1042D and the third list bending seams 1043D, the second list bending seams 1042D and the third list bending seams 1043D form two supporting section 15D. The supporting section 15D and the bottom wall 16D are in a plane, and the bottom wall 16D is capable of supporting the standing-type air-filled packaging apparatus to stand smoothly in the present embodiment.

When the second list bending seams 1042D and the third list bending seams 1043D are bent, as the first list bending seams 1041D and the fourth list bending seams fourth list bending seams 1044E are provided, two sides of the front and rear walls of the inflatable main body 10D are more easily connected. In other words, the side sealing lines 106D are easily connected together so that the lateral upper width of the standing-type air-filled packaging apparatus is smaller than the lower portion and is easier to stand.

It is worth mentioning that the inflatable main body 10D can be folded around the first list bending seams 1041D and the third list bending seams 1043D, so that the bottom wall is square and can also be folded along the first list bending seams 1041D and the fourth list bending seams fourth list bending seams 1044E, so that the bottom wall is elliptical to package the different items to be packaged.

Further, the fifth list bending seams 1045D is provided in the upper portion of the inflatable main body 10D, wherein two ends of the fifth list bending seams 1045D correspond to the side sealing lines 106D to bend the fifth list bending seams 1045D so as to form a top wall to close the opening of the accommodating cavity 100D, thereby preventing the items to be packaged from slipping out.

Referring to FIG. 19 to FIG. 22 of the drawings, the standing-type air-filled packaging apparatus according to a fourth preferred embodiment of the present invention is illustrated. As shown in FIG. 19 to FIG. 22 of the drawings, the standing-type air-filled packaging apparatus comprises an inflatable main body 10E, at least two inflating valve 20 and at least one side inflatable units 40E, wherein the inflatable main body 10E comprises at least one inflatable cells 11E, the side inflatable units 40E comprises at least one side air chambers 41E, the inflating valve 20 are respectively mounted to the inflatable cells 11E and the side air chambers 41E so as to inflate the inflatable cells 11E and the side air chambers 41E, thereby the inflatable main body 10E and the side inflatable units 40E having air cushioning performances.

The inflatable main body 10E is folded into a square box-like structure having a accommodating cavity 100E, wherein each of the two side portions of the accommodating cavity 100E has an opening, and the side inflatable units 40E is laterally mounted in the accommodating cavity 100E after being folded to divide the accommodating cavity 100E into three small sub-accommodating cavities. Moreover, the side opening of the accommodating cavity 100E is closed, the two side inflatable units 40E form two side walls of the accommodating cavity 100E, the inflatable main body 10E and the side inflatable units 40E are formed to form three enclosing spaces to protect the items to be packaged.

The inflatable main body 10E comprises a first chamber layer 101E and a second chamber layer 102E which are overlapped with each other, wherein the first chamber layer 101E and the second chamber layer 102E are overlapped with each other to form an inflatable cavity 12E, an air inflating opening 13E and an inflating channel 14E, wherein the air inflating opening 13E is connected to an air pump, the inflating channel 14E is input air and the air is distributed into each of the inflatable cavity 12E, so that the inflatable main body 10E has an air cushioning effect.

The inflatable main body 10E comprises a plurality of lists of bending seams 104E, wherein each of the bending seams 104E is disposed at intervals so as to facilitate the formation of the accommodating cavity 100E by bending the inflatable main body 10E. Specifically, the inflatable main body 10E comprises four lists of bending seams 104E which are respectively a first list bending seams 1041E, a second list bending seams 1042E, a third list bending seams 1043E and a fourth list bending seams 1044E, wherein the first list bending seams 1041E and the second list bending seams 1042E are bent to form a bottom wall 16E, a front wall and a rear wall. The third list bending seams 1043E and the fourth list bending seams 1044E are bent to form a top wall and a top cover, wherein the top wall corresponds to the bottom wall 16E and the front wall corresponds to the rear wall. As the height of the rear wall is longer than the height of the front wall, the top cover is adapted to compensate for the shortage spaces of the front wall and the rear wall, thereby forming the accommodating cavity 100E. The shape of the accommodating cavity 100E is square and all of the front wall, the rear wall, the top wall, the bottom wall, and the top cover are square. It is worth mentioning that two side portions of the accommodating cavity 100E are open.

It is worth mentioning that the first list bending seams 1041E, the second list bending seams 1042E and the surrounding sub-inflatable cells together form a supporting section 15E, wherein the supporting section 15E is provided between two side portions of the bottom wall 16E, wherein the supporting section 15E is in the same plane with the bottom wall 16E. The standing-type air-filled packaging apparatus is supported by the bottom wall 16E.

The side inflatable units 40E also comprises the side air chambers 41E, a side air inflating opening 43E and a side inflating channel 44E to be inflated and to have air cushioning performance, wherein the side inflatable units 40E comprises four lists of side bending seams 404E which are spaced with each other. The four lists of the side bending seams 404E respectively are a first list side bending seams 4041E, a second list side bending seams 4042E, a third list side bending seams 4043E and a fourth list side bending seams 4044E. The four lists of the side bending seams 404E are bent such that the side inflatable units 40E are formed to have a shape similar to the bent inflatable main body 10E. In other words, after the side inflatable units 40E are bent, a sub accommodating cavity is formed and two side portions of the sub accommodating cavity are open. Then two of the side inflatable units 40E are folded and put into the accommodating cavity 100E, and the rear wall of the side inflatable units 40E is formed as the side wall of the accommodating cavity 100E so as to enclose the accommodating cavity 100E and so as to form three sub accommodating cavities, thereby packaging three bottles or three other items.

The first list side bending seams 4041E and the second list side bending seams 4042E are bent to form a side bottom wall 46E. When the side inflatable units 40E is mounted on the inflatable main body 10E, the side bottom wall 46E coincides with the bottom wall 16E so as to form a double bottom wall at two ends of the bottom wall 16E, thereby forming three accommodating cavities.

It is worth mentioning that the front wall of the side inflatable units 40E is provided between two of the sub-accommodating cavities, and the top cover of the side inflatable units 40E is also provided between the two sub-accommodating cavities, so that the items within each sub-accommodating cavities are spaced apart from each other, so that the side inflatable units 40E has an air cushioning performance to prevent mutual impact among items to be packaged, thereby preferably protecting the items to be packaged.

Each of the sub-accommodating cavities is square to package square shaped items, the sub-accommodating cavities are also adapted to package cylindrical items such as bottles. The inflatable main body 10E and the side inflatable units 40E are detachably connected so as to be easy to assembly and disassembly, thereby adjusting the size of the sub-accommodating cavities.

In the preferred embodiment, the three sub-accommodating cavities which are formed by assembling two of the side inflatable units 40E with the inflatable main body 10E is exemplary only and not intended to be limiting. One skilled in the art will appreciate other alternatives and a plurality of sub accommodating cavities with same or different sizes are formed on other embodiments to package items.

Figure 23:
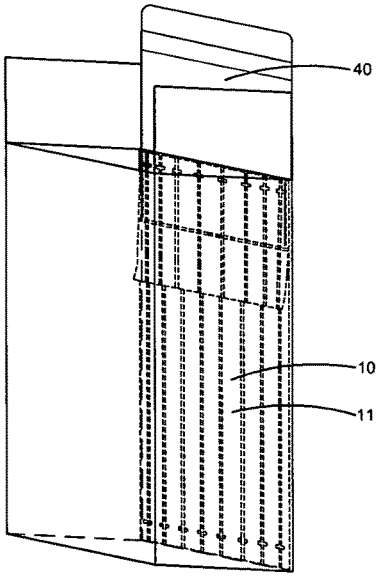
FIG. 23 is a perspective view and application of the standing-type air-filled packaging apparatus according to a fifth preferred embodiment of the present invention after being folded, wherein the standing-type air-filled packaging apparatus is not inflated and is fixed to an inner wall of a packaging box.
Figure 24:
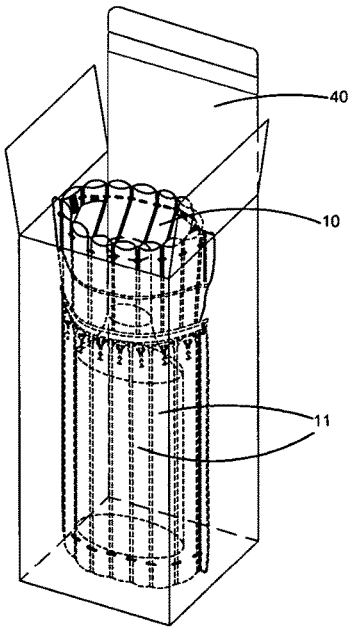
FIG. 24 is a perspective view and application of the standing-type air-filled packaging apparatus according to the fifth preferred embodiment of the present invention after being inflated.
Figure 25:
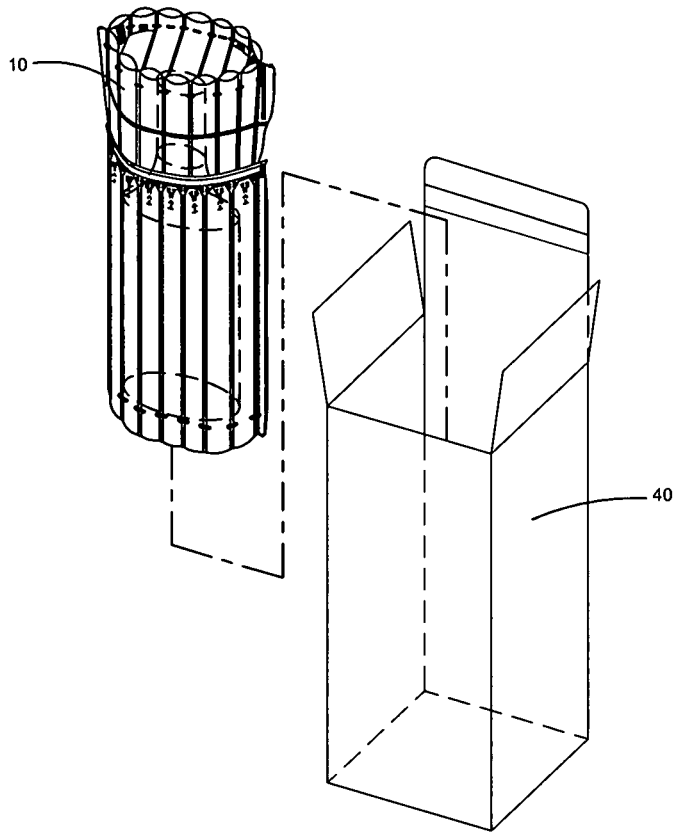
FIG. 25 is a perspective view and application of the standing-type air-filled packaging apparatus according to the fifth preferred embodiment of the present invention, wherein the standing-type air-filled packaging apparatus is assembled with the packaging box.

Referring to FIG. 23 to FIG. 25 of the drawings, the standing-type air-filled packaging apparatus according to a fifth embodiment of the present invention is illustrated. In this embodiment, the standing-type air-filled packaging apparatus of the first embodiment matched with a package box 40 to package items.

The standing-type air-filled packaging apparatus is capable of being placed in the package box 40 to package items. The package box 40 can be implemented as paper box to provide an additional protective cushioning effect on the outside of the standing-type air-filled packaging apparatus. According to this preferred embodiment, the uninflated standing-type air-filled packaging apparatus is further fixed in the package box 40 which is in an unfolded state. As shown in FIG. 23 of the drawings, when the standing-type air-filled packaging apparatus is inflated, each of the inflatable cells 11 of the standing-type air-filled packaging apparatus is expanded and further automatically brace the folded package box 40, so that the package box 40 is changed into an unfolded state, then the package box 40 with the standing-type air-filled packaging apparatus is further capable of packaging items.

It is worth mentioning that the standing-type air-filled packaging apparatus without being inflated is fixed to the package box 40 in a folded state and is easy to store and transport. During being used, the standing-type air-filled packaging apparatus is inflated to automatically brace the package box 40 to use.

It is worth mentioning that in the present invention, the terms of the upper, lower, top, bottom, lateral, longitudinal, etc. which represent azimuth and position are intended to be more clearly explained and do not limit the invention.

Figure 26:
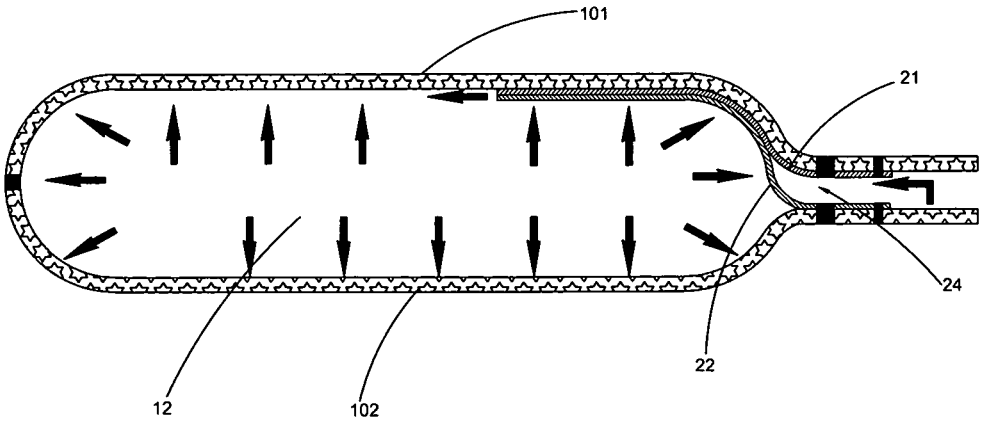
FIG. 26 is sectional view of a non-return inflating valve of the standing-type air-filled packaging apparatus according to the above preferred embodiment of the present invention.
Figure 27:
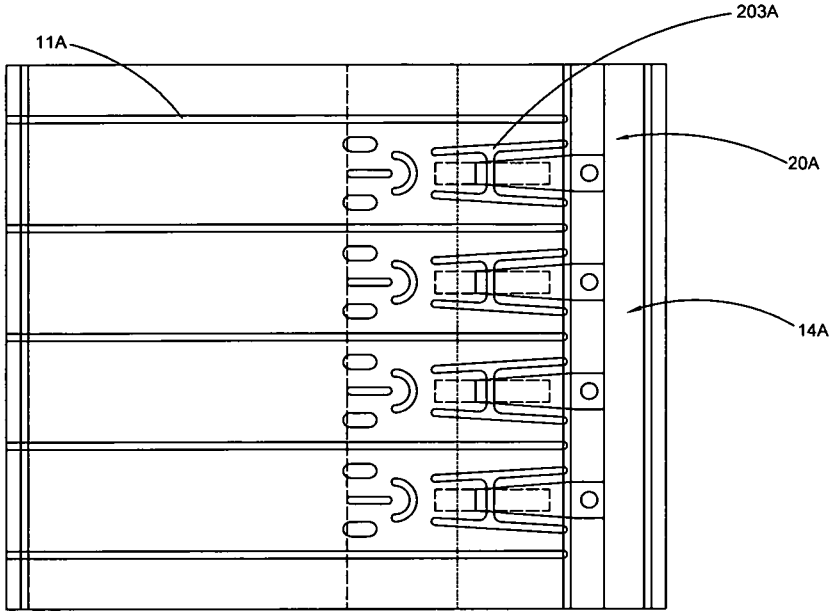
FIG. 27 to FIG. 29B are schematic views of another inflating valve of the standing-type air-filled packaging apparatus according to the above preferred embodiment of the present invention.
Figure 28:
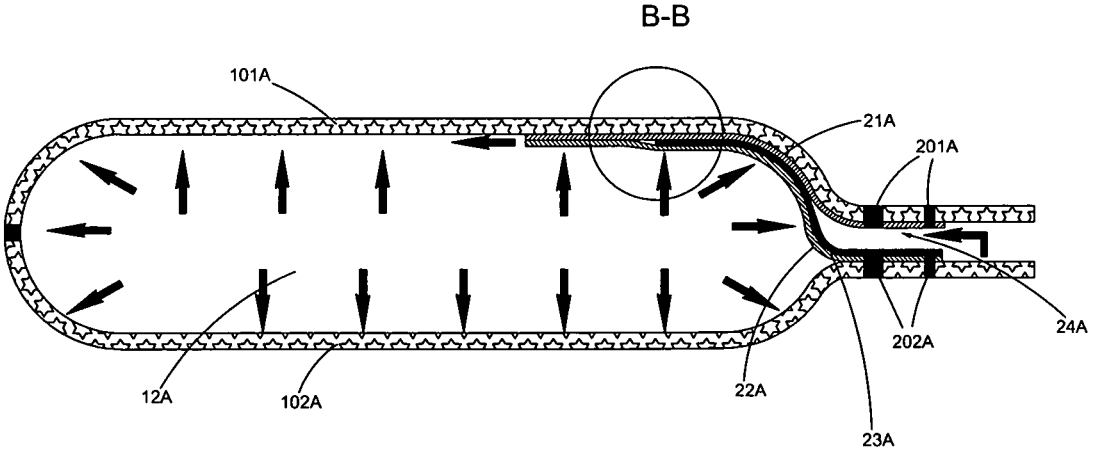
Figure 29A:
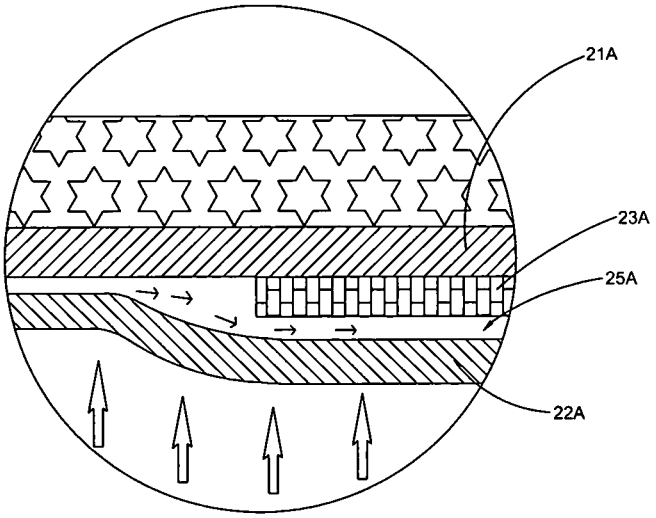
Figure 29B:
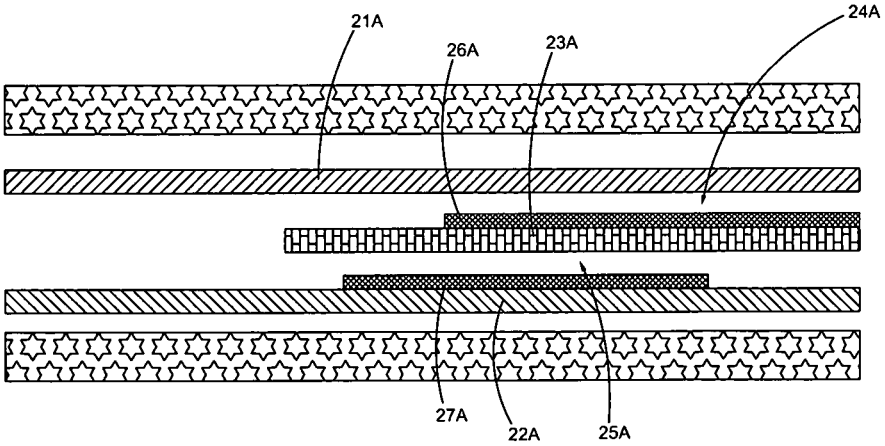

As shown in FIG. 26 of the drawings, the inflating valve 20 is a non-return valve comprising two sealing films 21 and 22. The first and second sealing films 21, 22 are overlapped between the first chamber layer 101 and the second chamber layer 102, so as to form a four-layer structure. An air inflating channel 24 is formed between the two sealing films 21 and 22. Correspondingly, after the inflatable main body 10 is inflated with air, the two sealing films 21, 22 are bonded together, so as to seal the air bag the air inflating channel, so that air is sealed into the inflatable cavity 12 of the inflatable main body 10. If the inflatable main body 10 comprises more than one inflatable cell 11, more than one inflating valve 20 is correspondingly provided to each of the inflatable cells 11, so as to seal air into each corresponding inflatable cells 11. Specially, the first sealing film 21 is overlapped and bonded to the first chamber layer 101. The second sealing film 22 is overlapped and bonded to the second chamber layer 102. When the inflatable main body 10 is being inflated, air is guided into the air inflating channel 24 formed between the first sealing film 21 and the second sealing film 22. When the inflatable main body is full of air, the first sealing film 21 and the second sealing film 22 are adhered with each other, so as to seal the air inflating channel 24 of the inflatable main body. In addition, the air pressure in the inflatable main body apply to the two sealing films 21 and 22, so as to ensure the two sealing films 21 and 22 adhering with each other tightly, so as to avoid air from leaking through the inflating valve 20. In other words, the inflating valve 20 is a non-return valve, which allows air to enter into the inflatable main body 10 and avoid air from leaking out of the inflatable main body 10.

The forming of the air inflating channel 24 of the inflating valve 20 is realized by providing a blocking device between the two sealing films 21 and 22. When the two sealing films 21 and 22 and the first chamber layer 101 and the second chamber layer 102 are being sealing, due to the blocking device is provided, the two sealing films 21 and 22 are not entirely sealed together, so as to form the air inflating channel 24. According to one embodiment of the present invention, the blocking device can be high temperature durable ink.

Referring to FIG. 27 to FIG. 29B of the drawings, a standing-type air-filled packaging apparatus according to another alternative mode of the present invention is illustrated, which mainly illustrates the structure of another inflating valve 20A. The inflating valve 20A is a double non-return valve, so as to provide double sealing effect to the inflatable main body. The inflating valve 20A comprises a first sealing film 21A, a second sealing film 22A and a non-return sealing film 23A.

The first sealing film 21A and the second sealing film 22A are overlapped between the first chamber layer 101A and the second chamber layer 102A of the inflatable cell 11A. The first sealing film 21A and the second sealing film 22A are two thin flexible films overlapping with each other, which are made of plastic. Preferably, the first sealing film 21A and the second sealing film 22A are two same films.

Each of the first sealing films 21A and the second sealing films 22A has a first edge, i.e. a near edge extended to the exit of the inflating valve 20A of the inflatable cell 11A, and a second edge, i.e. A far edge extended into the inflatable cell. Preferably, the first edges and the second edges of the first sealing films 21A and the second sealing films 22A are respectively adjacent to each other.

In the present embodiment, the proximal edge of the first sealing film 21A is bonded to the first gas chamber film 101A. And the proximal edge of the second sealing film 22A is bonded to the second air chamber film 102A.

The return sealing film 23A is superimposed on the proximal end of the first sealing film 21A and the second sealing film 22A so as to form an inflation between the first sealing film 21A and the return sealing film 23A Channel 24A, and a return passage 25A is formed between the return sealing film 23A and the second sealing film 22A.

The air inflating channel 24A is arranged to be used to inflate air into the inflatable cavity 12A so as to fill the inflatable cell 11A until the air in the inflatable cavity 12A can make the seconds edges of the first sealing film 21A and the second sealing film 22A to be overlapped to seal and to close the air inflating channel 24A. According to this preferred embodiment of the present invention, if air is leaked through space between the second edges of the first sealing film 21A and the second sealing film 22A, the air in the inflatable cavity 12 is guided into the non-return channel 25A, so as to provide an air supplement and further seal the air inflating channel 24A, so as to enhance the sealing effect of the first sealing film 21A and the second sealing film 22A.

The air inflating channel 24A has two open ends which are a first open end and a second open end. A near open end is formed between the first edges of the first sealing film 21A and the first end of the corresponding non-return sealing film 23A. A second open end is extended to the second edge of the first sealing film 21A and the second edge of the corresponding second sealing film 22A, so as to communicate with the inflatable cavity 12A. Compressed air can be guided into the inflatable cavity 12A through the air inflating channel 24A.

It is worth mentioning that when the inflating unit 11A is filled with air, the air pressure in the inflatable chamber 12A applies pressure to the first sealing film 21A and the second sealing film 22A to seal the first seal The film 21A and the second sealing film 22A, and seals the distal open end of the inflatable passage 24A. In addition, the distal ends of the first sealing film 21A and the second sealing film 22A are sealed together by the surface tension.

The non-return sealing film 23A is thin flexible film made of plastic. Preferably, the non-return sealing film 23A, the first sealing film 21A and the second sealing film 22A are poly ethylene films. In addition, the thickness of each first chamber layer 101A and each second chamber layer 102A is greater than the thickness of the first sealing film 21A, the second sealing film 22A and the non-return sealing film 23A.

According to the preferred embodiment of the present invention, the length of the non-return sealing film 23A is smaller than the length of the first sealing film 21A and the second sealing film 22A, so that when the non-return sealing film 23A overlaps to the first edge of the first sealing film 21A and the second sealing film 22A, the second edge of the first sealing film 21A and the second edge of the second sealing film 22A are overlapped together. It is worth mentioning that the length of the non-return sealing film 23A is defined as the distance between the first edge of the non-return sealing film 23A and the second edge of the non-return sealing film 23A. The length of each first sealing film 21A is defined as the distance between the first edge of the first sealing film 21A and the second edge of the first sealing film 21A. The length of the second sealing film 22A is defined as the distance between the first edge of the second sealing film 22A and the second edge of the second sealing film 22A.

Correspondingly, the first edge of the first sealing film 21A and the first edge of the second sealing film 22A and the first edge of the non-return sealing film 23A are adjacent to each other. In addition, the first edge of the non-return sealing film 23A is bonded to the first edge of the second sealing film 22A.

The non-return channel 25A is form between the non-return sealing film 23A and the second sealing film 22A, wherein the non-return channel 25A has an open end facing the inflatable cavity 12A and a closed end facing the opening of the air valve. In other words, the first edge of the non-return channel 25A is the closed end and the second edge of the non-return channel 25A is the open end.

Correspondingly, while air in inflated into the non-return channel 25A through the open end, the non-return channel 25A is filled with air to product a pressure supplement, so as to further seal the air inflating channel 24A between the first sealing film 21A and the second sealing film 22A.

It is worth mentioning that while inflating air into the inflatable cavity 12A through the air inflating channel 24A, the flow direction of the air in the air inflating channel 24A is opposite to the flow direction of the air in the non-return channel 25A. Thus, air will not be filled into the non-return channel 25A. While air is leaked back from the inflatable cavity 12A to the non-return channel 25A, air enters into the non-return channel 25A, so as to generate a pressure supplement and further seal the air inflating channel 24A, so as to avoid leaking air. It is worth mentioning that before being leaked through the first open end of the air inflating channel 24A, the leaked air flows from the second end of the air inflating channel 24A to the second open end of the non-return channel 25A, so as to avoid the air being leaked. In addition, the non-return sealing film 23A and the first sealing film 21A are sealed together due to the surface tension, so as to seal the air inflating channel 24A.

In order to form the inflating valve 20A to the inflatable cell 11A, the inflating valve 20A further comprises a first seal joint portion 201 and a second seal joint portion 202. The first seal joint portion is provided to bond the first chamber layer 101A and the first sealing film 21A together at the opening of the air valve of the inflatable cell 11A. The second seal joint portion is used to bond the second chamber layer 102A, the non-return sealing film 23A and the second sealing film 22A together at the opening of the air valve of the inflatable cell 11A.

Correspondingly, the first edge of the first sealing film 21A is bonded to the first chamber layer 101A via the first seal joint portion 201. The second chamber layer 102A, the first edge of the second sealing film 22A and the first edge of the non-return sealing film 23A are bonded together via the second seal joint portion 202A. Preferably, two interval seal joint portions 201A are used to bond the first chamber layer 101A and the first sealing film 21A. Two interval second seal joint portions 202A are used to bond the second chamber layer 102A, the non-return sealing film 23A and the second sealing film 22A. It is worth mentioning that the first seal joint portion 201A and the second seal joint portion 202A not only can be heat sealing line, but also can be heat sealing which other shapes. In other words, the first edge of the first sealing film 21A and the first chamber layer 101A are sealed together via the seal joint portion 201A. The second chamber layer 102A and the first edge of the second sealing film 22A and the first edge of the non-return sealing film 22 are sealed together via the second seal joint portion 202A.

In order to keep a space between the first sealing film 21A and the non-return sealing film 23A after being sealed, the inflating valve 20A further comprises a first heat resisting item 26A, which is formed between the first sealing film 21A and the non-return sealing film 23A, so as to ensure the air inflating channel 24A being formed. The first heat resisting item 26A is provided to avoid the first sealing film 21A and the non-return sealing film 23A being entirely bonded together during the process of heat sealing.

Specifically, the first heat resisting item 26A is provided to the first edge of the first sealing film 21A, the first edge of the non-return sealing film 23A and the opening of the air valve of the inflatable cell 11A, so as to ensure the first end of the air inflating channel 24A being in an opening state.

Similarly, in order to keep the space between the second sealing film 22A and the non-return sealing film 23A after the process of heat sealing, the inflating valve 20A further comprises a second heat resisting item 27A formed between the second sealing film 22A and the non-return sealing film 23A to ensure forming of the non-return channel 25A.

Specifically, the second heat resisting item 27A is provided to the second edge of the second sealing film 22A and the second edge of the non-return sealing film 23A, so as to ensure the second end of the non-return channel 25A being in an opening state. It is worth mentioning that the first end of the non-return channel 25A is closed by the second seal joint portion 202.

According to the preferred embodiment of the present invention, the first heat resisting item 26A and the second heat resisting item 27A are two heat-resisting layers, which are coated to predetermined position of corresponding films, so as to avoid the films being attached together at the process of heat sealing. The first heat resisting item 26A is extended to the first end of the non-return sealing film 23A and faces to the first sealing film 21A. The second heat resisting item 27A is extended to an opposite side of the second end of the non-return sealing film 23A and faces to the second sealing film 22A, wherein the second heat resisting item 27A is not provided to the opposite side of the first end of the non-return sealing film 23A, thus, the first end of the non-return channel 25A can be closed by the second seal joint portion 202A. It is worth mentioning that the second heat resisting item 27A not only avoid the non-return sealing film 23A and the second sealing film 22A being attached together to ensure the second end of the non-return channel 25A being in an opening state, but also enhance the force between the non-return sealing film 23A and the first sealing film 21A, so as to close the air inflating channel 24A via surface tension.

The inflating valve 20A further comprises two side seal joint portions 203A, i.e. two third seal joint portions being used to attach the first sealing film 21A and the non-return sealing film 23A, so as to form side walls of the air inflating channel 24A. The width of the air inflating channel 24A is defined by the two side seal joint portions 203A. In detail, the two side seal joint portions 203A are two slant heat-sealing lines, so that the width of the air inflating channel 24A decreases progressively from the inflatable cavity at the opening of the air valve. In other words, a near opening end of the air inflating channel 24A is a bigger opening end communicating with the opening of the air valve. A far opening end of the air inflating channel 24A is a taper opening end communicating with the inflatable cavity 12A. The taper air inflating channel 24A further avoids air from being leaked to the opening of the air valve from the inflatable cavity 12A.

Preferably, the side seal joint portions 203A are extended from the first edge of the first sealing film 21A and the first edge of the second sealing film 22A to the second edge of the first sealing film 21A and the second edge of the second sealing film 22A. Thus, the side seal joint portions 203A are provided to the first end of the first sealing film 21A and the first end of the second sealing film 22A, and are attached together with the non-return sealing film 23A. The side seal joint portions 203A are provided to the second end of the first sealing film 21A and the second end of the second sealing film 22A and are attached together with the first sealing film 21A and the second sealing film 22A.

Correspondingly, in order to inflate into the inflatable cell 11A, a pump is inserted to the air inflating opening 13A to fill compressed air into the air inflating channel 24A, wherein the air inflating direction is from the first opening end of the air inflating channel 24A to the second opening end of the air inflating channel 24A. Thus, the inflatable cells 11A start to be inflated. The pressure of inflatable cavity 12A is enlarged to push the first chamber layer 101A and the second chamber layer 102A. At the same time, the pressure acts on the first sealing film 21A and the second sealing film 22A, and particularly on the second end of the first sealing film 21A and the second end of the second sealing film 22A. After the inflatable cell 11A is fully filled with air, i.e. The maximum loading lever is reached, the pressure in the inflatable cavity 12A is big enough to seal the second end of the first sealing film 21A and the second end of the second sealing film 22A, so as to seal the second opening end of the air inflating channel 24A automatically. Then the pump is put out of the air inflating opening 13A.

While the second end of the first sealing film 21A and the second end of the second sealing film 22A are not entirely sealed together, it is likely that the air in the inflatable cavity 12A being leaked to the air inflating channel 24A. To avoid air from being leaked to the air inflating channel 24A, the non-return sealing film 23A is sealed to the first sealing film 21A to seal the second opening end of the air inflating channel 24A. In detail, the air inflow direction of the non-return channel 25A is opposite to the air inflating direction of the air inflating channel 24A. In addition, while the opening end of the non-return channel 25A being open, the second opening end of the air inflating channel 24A is closed. Thus, air enters from the opening end of the non-return channel 25A and is retained in the non-return channel 25A.

The non-return channel 25A is filled with air, so a pressure supplement is produced in the non-return channel 25A to further seal the air inflating channel 24A. Specially, the second opening end of the air inflating channel 24A between the first sealing film 21A and the non-return sealing film 23A is sealed. More specifically, the higher the pressure supplement in the non-return channel 25A is, the better the sealing effect of the non-return sealing film 23A is. In other words, while air is leaked from the inflatable cavity 12A to reduce the pressure of the inflatable cavity 12A, air enters into the non-return channel 25A to enhance the pressure of the non-return channel 25A. Thus, the total pressure of inflating, i.e. the sum of the pressure of the inflatable cavity 12A and the pressure of the non-return channel 25A remains unchanged. Thus, air enters into the non-return channel 25A from the inflatable cavity 12A enhance the sealing effect of the air inflating channel 24A.

It is worth mentioning that the structure of inflatable valve mentioned above is exemplary only and is not intended to be limiting. In practice, the inflatable valve can be implemented as inflatable valves with other structures.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A standing-type air-filled packaging apparatus, comprising:

at least one inflatable main body, wherein said inflatable main body comprises a plurality of connected inflatable cells formed by at least two chamber layers which are overlapped with each other, wherein said plurality of connected inflatable cells is heat sealed and bent to form an air-filled packaging apparatus having at least one accommodating cavity for accommodating items to be packaged; and at least one inflating valve mounted to said inflatable main body so as to inflate said inflatable main body, wherein at least one end side of said air-filled packaging apparatus forms a recessed cushioning chamber after said air-filled packaging apparatus is inflated, so that said end side is suitable for making said air-filled packaging apparatus being in a firm standing state;

wherein said end side of said standing-type air-filled packaging apparatus after being inflated comprises an end wall and two or more supporting sections which are protruded from said end wall, so that said end wall and said supporting section form said cushioning chamber, wherein said end side of said standing-type air-filled packaging apparatus comprises a first list interconnecting seam, a second list interconnecting seam, a third list interconnecting seam and a fourth list interconnecting seam which heat seal two layers of said chamber layer of said plurality of connected inflatable cells, wherein said first list interconnecting seam, said second list interconnecting seam, said third list interconnecting seam and said fourth list interconnecting seam are provided to make said plurality of connected inflatable cells communicates in the lengthwise direction, wherein said first and second list interconnecting seam further are heat sealed together so as to form said supporting section which is folded back between said first and second interconnecting seam, wherein said third and fourth interconnecting seam further are heat sealed to form other supporting section which is folded back between said third and fourth interconnecting seam, wherein said end wall is formed between said second and third interconnecting seam.

2. The standing-type air-filled packaging apparatus, as recited in claim 1, wherein said end wall is selected from the group consisting of top wall and bottom wall.

3. The standing-type air-filled packaging apparatus, as recited in claim 1, wherein two of said supporting sections are heat sealed by a side sealing line so as to form an entire annular supporting portion.

4. The standing-type air-filled packaging apparatus, as recited in claim 1, wherein further provided with one or more lists of bending seams between said first and second list interconnecting seam and between said third and fourth list interconnecting seam, so that said supporting section is suitable to be bent along said bending seams.

* * * * *